US010756424B2

(12) United States Patent
Pan et al.

(10) Patent No.: US 10,756,424 B2
(45) Date of Patent: Aug. 25, 2020

(54) MODE BALANCING PARASITIC STRUCTURE FOR A MULTIMODE ACTIVE ANTENNA ARRAY

(71) Applicant: NOKIA TECHNOLOGIES OY, Espoo (FI)

(72) Inventors: Xuyuan Pan, Alburquerque, NM (US); David Hendry, New Providence, NJ (US)

(73) Assignee: NOKIA TECHNOLOGIES OY, Espoo (FI)

( * ) Notice: Subject to any disclaimer, the term of this patent is extended or adjusted under 35 U.S.C. 154(b) by 65 days.

(21) Appl. No.: 16/197,739

(22) Filed: Nov. 21, 2018

(65) Prior Publication Data

US 2020/0161753 A1 May 21, 2020

(51) Int. Cl.

| | |
|---|---|
| ***H01Q 1/52*** | (2006.01) |
| ***H01Q 21/06*** | (2006.01) |
| ***H01Q 21/00*** | (2006.01) |
| ***H01Q 1/48*** | (2006.01) |

(52) U.S. Cl.

CPC ..... *H01Q 1/523* (2013.01); *H01Q 1/48* (2013.01); *H01Q 21/0025* (2013.01); *H01Q 21/061* (2013.01)

(58) Field of Classification Search

CPC ..... H01Q 1/52; H01Q 1/523; H01Q 1/48; H01Q 21/0025; H01Q 21/061

See application file for complete search history.

(56) References Cited

U.S. PATENT DOCUMENTS

| | | | | |
|---|---|---|---|---|
| 6,894,653 | B2 * | 5/2005 | Chiang | H01Q 1/2258 343/757 |
| 9,203,139 | B2 | 12/2015 | Zhu et al. | |
| 9,590,297 | B2 | 3/2017 | Ai et al. | |
| 9,614,276 | B2 | 4/2017 | Pinto et al. | |
| 9,912,080 | B2 * | 3/2018 | Louzir | H01Q 25/005 |
| 2015/0194740 | A1 | 7/2015 | Ju | |

FOREIGN PATENT DOCUMENTS

| | | |
|---|---|---|
| WO | WO 2017/020114 A1 | 2/2017 |
| WO | WO 2017/212287 A1 | 12/2017 |

OTHER PUBLICATIONS

Shoaib, S. et al., *Design and Performance Study of a Dual-Element Multiband Printed Monopole Antenna Array for MIMO Terminals*, IEEE Antennas and Wireless Propagation Letters, vol. 13 (2014) 329-332.

* cited by examiner

*Primary Examiner* — Hoang V Nguyen
(74) *Attorney, Agent, or Firm* — Alston & Bird LLP

(57) ABSTRACT

An apparatus is provided to mitigate the adverse effects of mutual coupling. The apparatus includes a ground plane and first and second active radiators spaced from the ground plane. The first and second active radiators are configured to the electrically coupled to at least one of a receiver, a transmitter or a transceiver. The antenna also includes a grounded radiator electrically coupled to the ground plane and positioned between the first and second active radiators. The ground plane defines a non-conductive slot positioned between the first and second active radiators and bounded by the ground plane.

22 Claims, 18 Drawing Sheets

| Mode1: | Mode2: | Mode3: |
|---|---|---|
| + + +<br>+ + +<br>+ + + | + − +<br>+ − +<br>+ − + | + + +<br>− − −<br>+ + + |
| **Mode4:** | **Mode5:** | **Mode6:** |
| + 0 −<br>+ 0 −<br>+ 0 − | + + +<br>0 0 0<br>− − − | + 0 −<br>0 0 0<br>− 0 + |
| **Mode7:** | **Mode8:** | **Mode9:** |
| + 0 −<br>− 0 +<br>+ 0 − | + − +<br>0 0 0<br>− + − | + − +<br>− + −<br>+ − + |

Mode 1

Mode 9

MODE BALANCING PARASITIC STRUCTURE FOR A MULTIMODE ACTIVE ANTENNA ARRAY

TECHNOLOGICAL FIELD

An example embodiment relates generally to a multi-mode active antenna array and, more particularly, to a mode balancing parasitic structure for a multi-mode active antenna array.

BACKGROUND

Multiple-input multiple-output (MIMO) antennas may suffer from mutual coupling. Mutual coupling may degrade both the signal-to-interference-noise ratio (SINR) of an antenna array and the convergence of the array's signal processing algorithms. Further, mutual coupling may degrade the estimations of carrier frequency offset, channel estimation, angle of arrival, error rate and capacity of a MIMO antenna. Due to the random phase excitations at the antenna ports during transmission by a MIMO antenna, mutual coupling may also have an adverse effect on the active voltage standing wave ratio (VSWR).

Wireless communication products utilizing MIMO antenna arrays may place upper and lower bounds on the space that may be occupied by a MIMO antenna. The typically compact nature of this space leads to the radiating elements of a MIMO antenna being located in close proximity to one another, which may satisfy the compactness requirements, but at the cost of performance degradation as a result of the effects of mutual coupling which are only heightened by the close proximity of the radiating elements.

In an effort to mitigate mutual coupling, MIMO precoding and decoding schemes have been implemented. However, the output SINR of an adaptive MIMO antenna array cannot be improved by compensating for the mutual coupling only during the post-processing stage. Various diversity techniques, such as space diversity, polarization diversity and pattern diversity, have also been utilized to address the degradation in antenna performance brought about by mutual coupling. However, these various diversity techniques also have generally been of only limited usefulness in controlling the adverse effects of mutual coupling.

BRIEF SUMMARY

An apparatus, such as an antenna, is provided in accordance with an example embodiment in order to mitigate the adverse effects of mutual coupling in an antenna, such as a MIMO antenna. In this regard, the apparatus, such as the antenna, of an example embodiment includes a parasitic structure that provides for mode balancing and correspondingly reduces mutual coupling. As a result, the SINK of an antenna, such as a MIMO antenna may be improved, even in instances in which the radiating elements of the MIMO antenna are closely spaced, such as in the embodiment in which the MIMO antenna is incorporated into a wireless communication product that allows only limited space for the MIMO antenna.

In an example embodiment, an apparatus, such as an antenna, is provided that includes a ground plane and first and second active radiators spaced from the ground plane. The first and second active radiators are configured to the electrically coupled to at least one of a receiver, a transmitter or a transceiver. The apparatus also includes a grounded radiator electrically coupled to the ground plane and positioned between the first and second active radiators. The ground plane defines a non-conductive slot positioned between the first and second active radiators and bounded by the ground plane.

The slot of an example embodiment extends in opposite directions from the grounded radiator. In this example embodiment, the slot extends in equal distances and in opposite directions from the grounded radiator such that the grounded radiator is centrally disposed relative to the slot. The slot of an example embodiment comprises a rectangular slot. In this example embodiment, the first and second active radiators may be spaced apart from one another along a reference line. The rectangular side of this example embodiment may be oriented relative to the reference line so as to have a width in a direction parallel to the reference line and a length in a direction perpendicular to the reference line. In an example embodiment, the first and second active radiators comprise first and second active monopoles, and the grounded radiator comprises a grounded monopole. The grounded monopole of this example embodiment extends through the slot. The grounded monopole of an example embodiment is positioned at a midpoint between the first and second active monopoles. In another example embodiment, an electronic device is provided that comprises the apparatus, such as the antenna.

In another example embodiment, an apparatus, such as an antenna array, is provided that includes a ground plane and a plurality of active radiators. The plurality of active radiators comprise at least first, second, third and fourth active radiators. The plurality of active radiators are spaced from the ground plane. The apparatus also includes a first grounded radiator electrically coupled to the ground plane and centrally disposed relative to the first, second, third and fourth active radiators. The ground plane defines a non-conductive cross-shaped slot centrally disposed relative to the first, second, third and fourth active radiators. The cross-shaped slot comprises first and second slot components oriented so as to intercept one another at medial portions thereof.

The cross-shaped slot of an example embodiment is configured such that the first and second slot components intercept one another at a point of intersection located midway along each of the first and second slot components. In an example embodiment, the cross-shaped slot is configured such that the first and second slot components are perpendicularly oriented relative to one another. Each of the slot components of an example embodiment is aligned with and extends along the line between two of the active radiators. In an example embodiment, the first, second, third and fourth active radiators comprise first, second, third and fourth active monopoles, and the first grounded radiator comprises a first grounded monopole. The first grounded monopole of this example embodiment extends through the cross-shaped slot at the point of intersection.

The apparatus, such as the antenna array, of an example embodiment further comprises a second grounded radiator electrically coupled to the ground plane and positioned between the first and second active radiators. The apparatus also includes a non-conductive slot defined by the ground plane and positioned between the first and second active radiators. The slot of an example embodiment extends in equal and opposite directions from the second grounded radiator. In this example embodiment, the first and second active radiators may be spaced apart from one another along the reference line. The slot of this example embodiment is oriented relative to the reference line so as to have a width in direction parallel to the reference line and a length in a direction perpendicular to the reference line. In this regard, the direction perpendicular to the reference line also intersects the first grounded radiator. The second grounded radiator of an example embodiment extends through the slot. In an example embodiment, the second grounded radiator is positioned at a mid-point between the first and second active radiator. The apparatus of an example embodiment further comprises a third grounded radiator and a non-conductive slot between the second and third active radiators, a fourth grounded radiator and a non-conductive slot between the third and fourth active radiators and a fifth grounded monopole and a non-conductive slot between the first and fourth active radiators. In another example embodiment, an electronic device is provided that comprises the apparatus, such as the antenna array.

In an example embodiment, the plurality of active radiators comprise a 3×3 array of active radiators. In this example embodiment, the apparatus, such as the antenna array, further comprises a plurality of parasitic structures. Each parasitic structure comprises a grounded radiator electrically coupled to the ground plane and a non-conductive cross-shaped slot defined by the ground plane. Each parasitic structure is centrally disposed with respect to four neighboring active radiators of the 3×3 array.

In another example embodiment, the plurality of active radiators comprise a 4×4 array of active radiators. The apparatus, such as the antenna array, of this example embodiment further comprises a plurality of parasitic structures. Each parasitic structure comprises a grounded radiator electrically coupled to the ground plane and a non-conductive cross-shaped slot defined by the ground plane. Each parasitic structure is centrally disposed with respect to four neighboring active radiators of the 4×4 array.

BRIEF DESCRIPTION OF DRAWINGS

Figure 1:
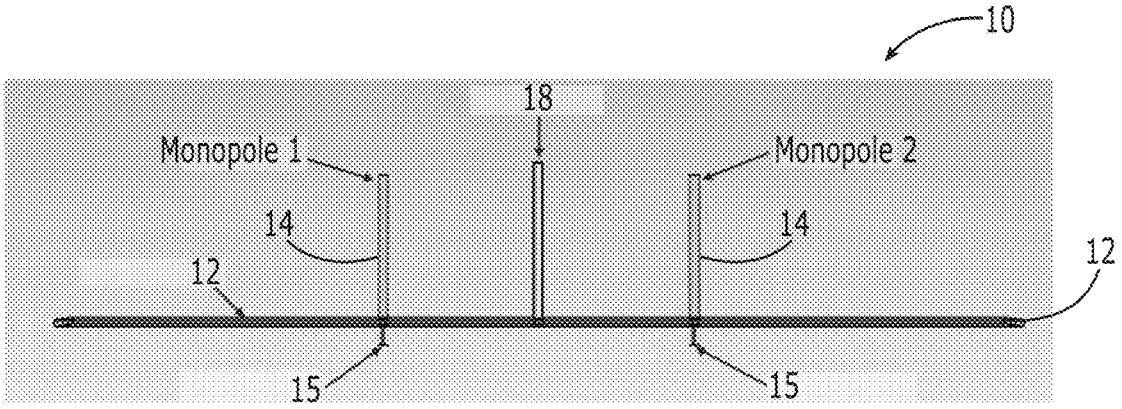
Figure 2:
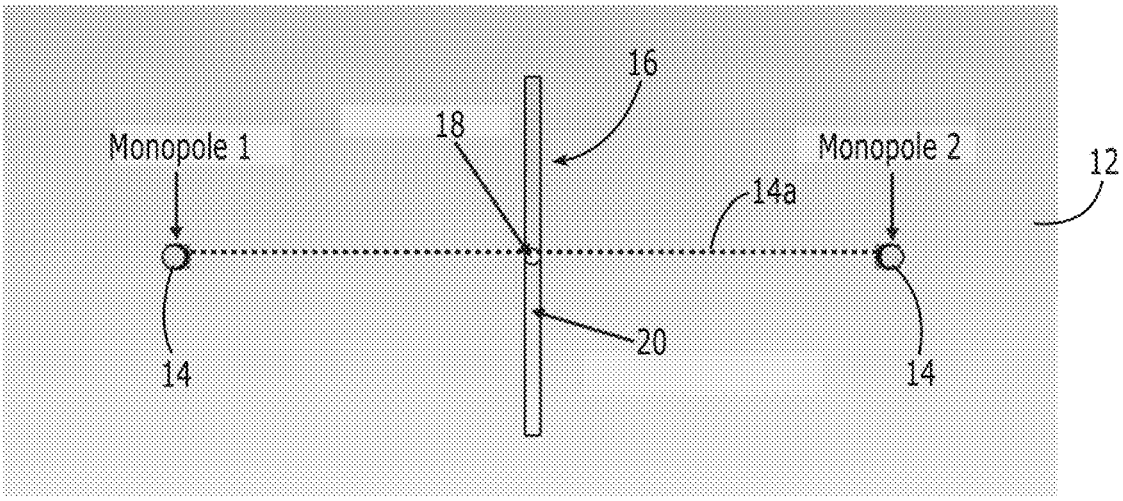
Figure 3:
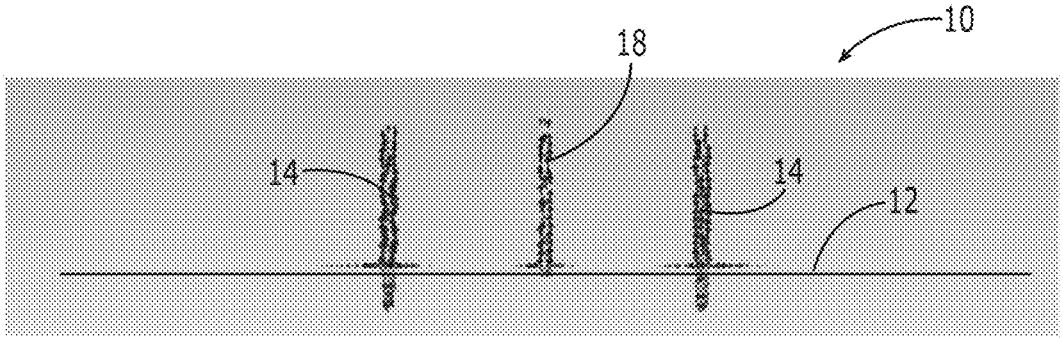
Figure 4:
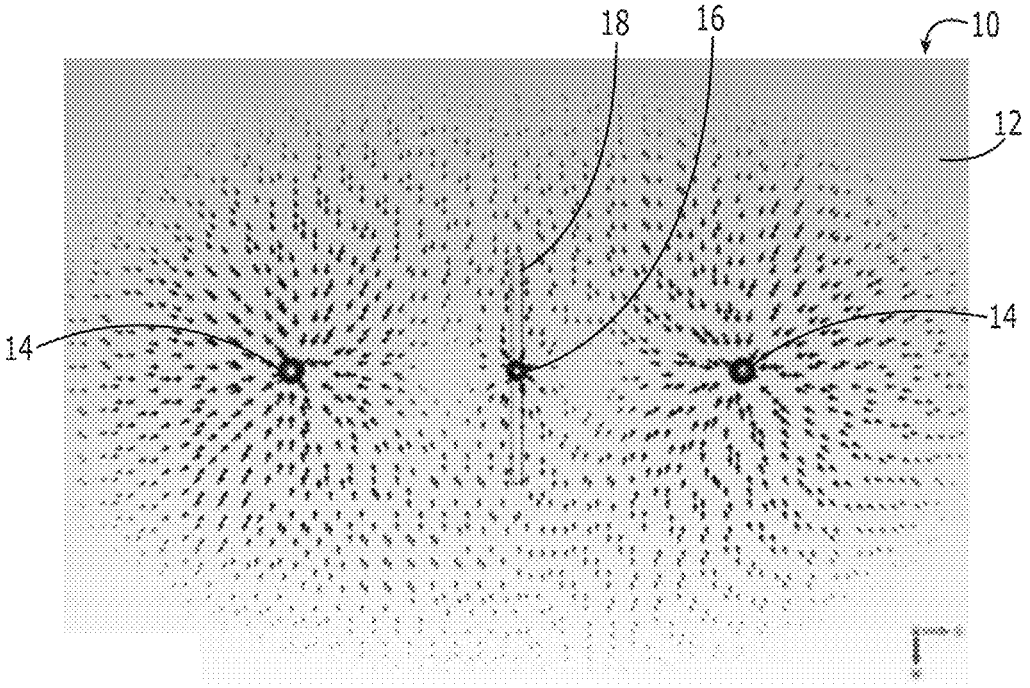
Figure 5:
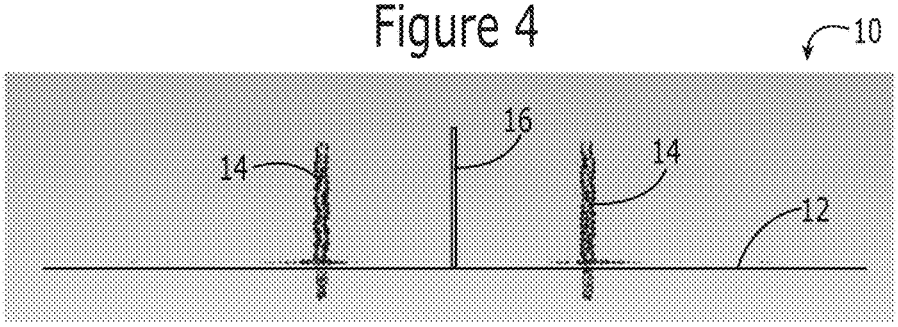
Figure 6:
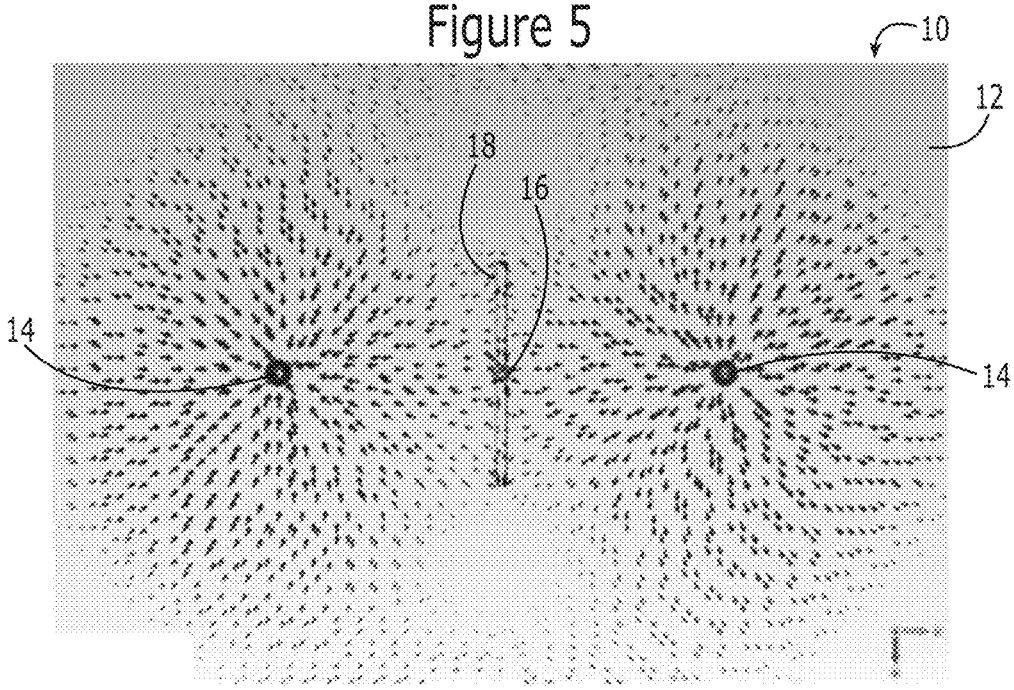
Figure 7:
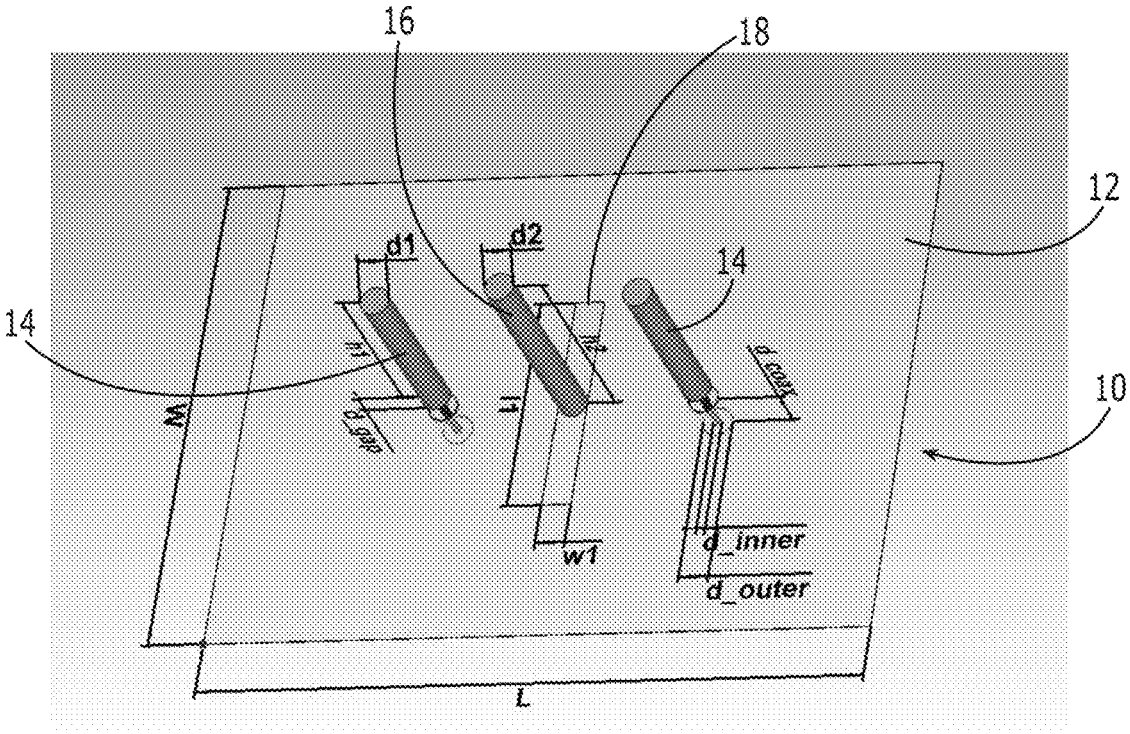
Figure 8:
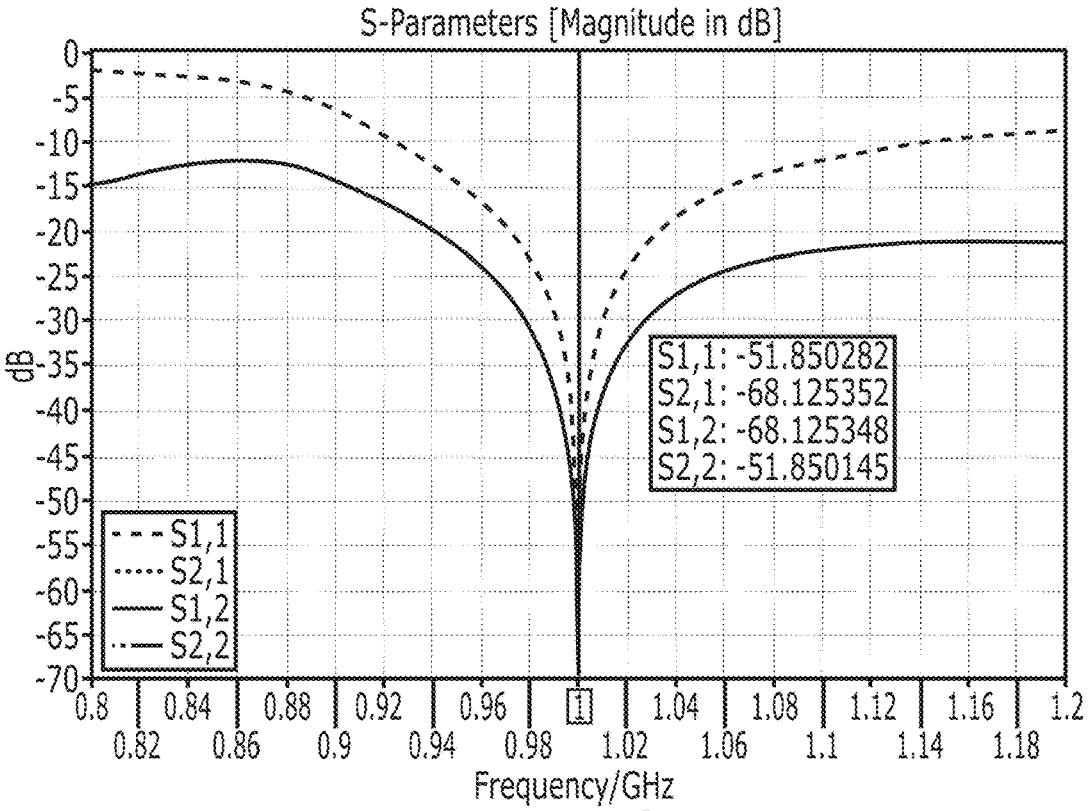
Figure 9:
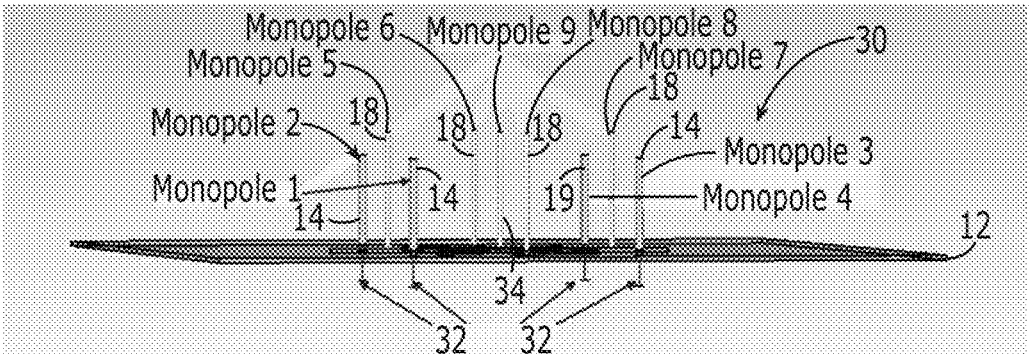
Figure 10:
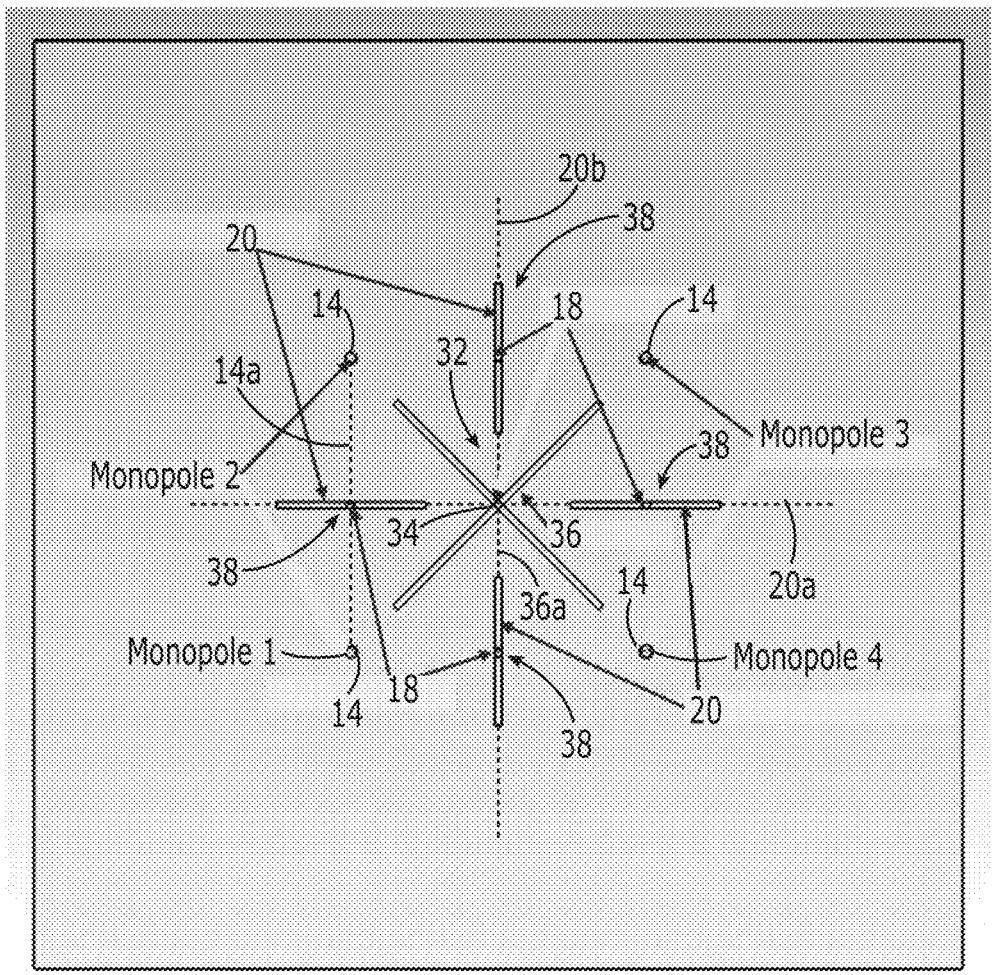
Figure 11:
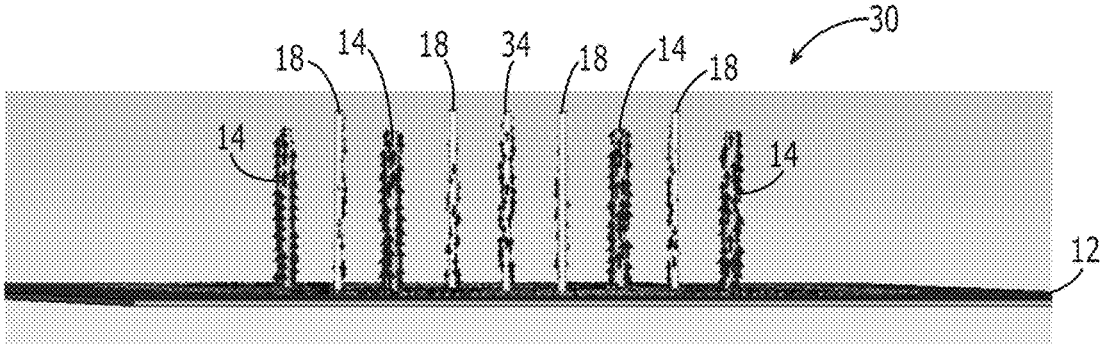
Figure 12:
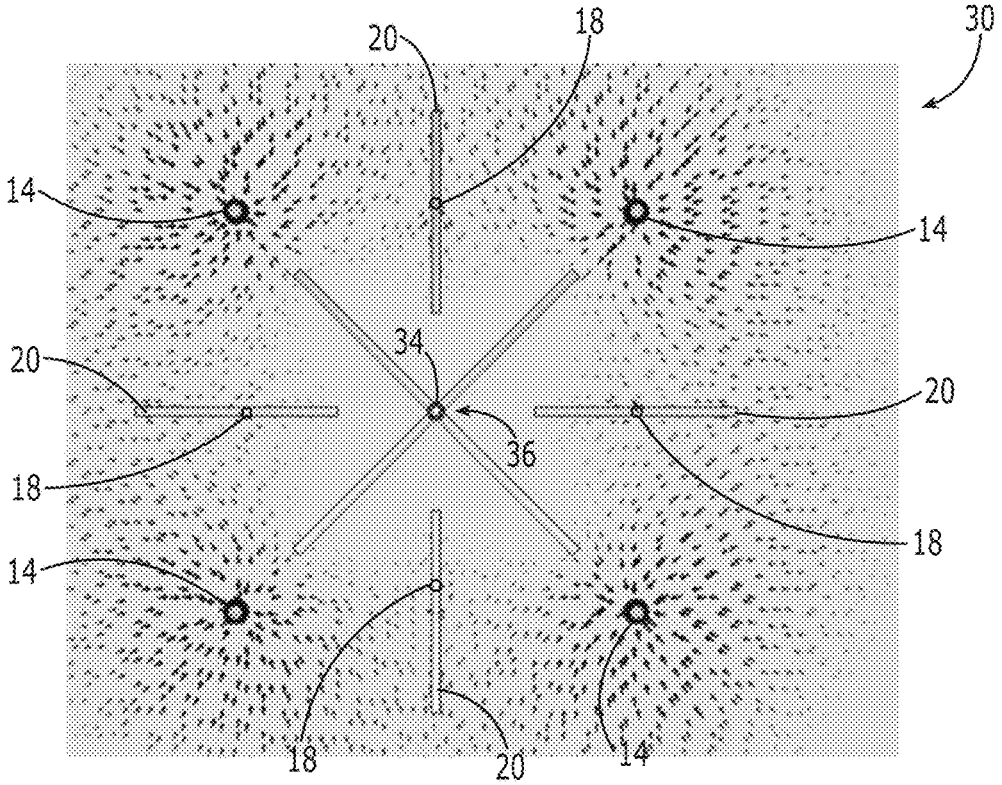
Figure 13:
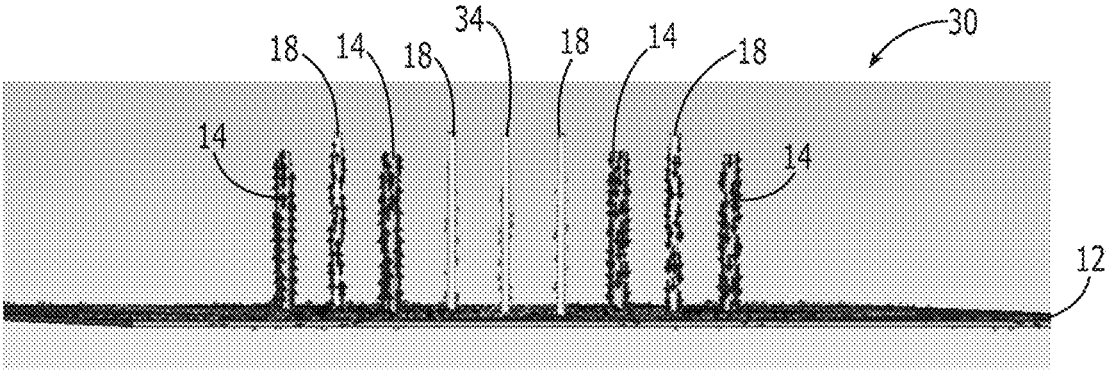
Figure 14:
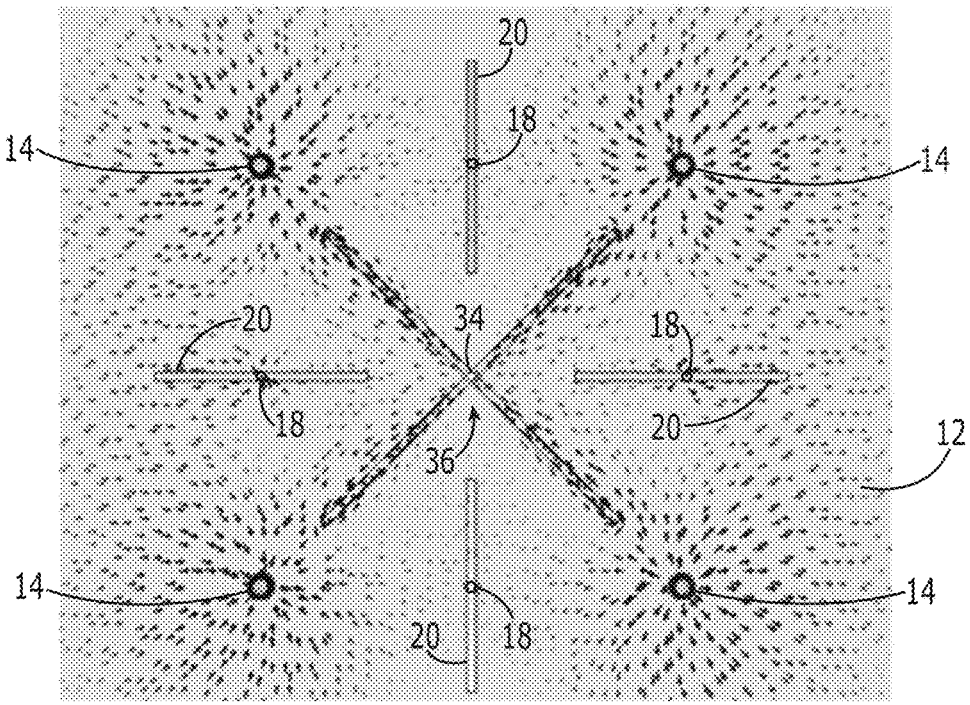
Figure 15:
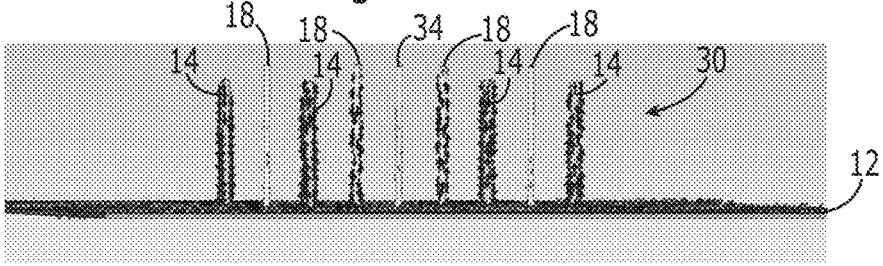
Figure 16:
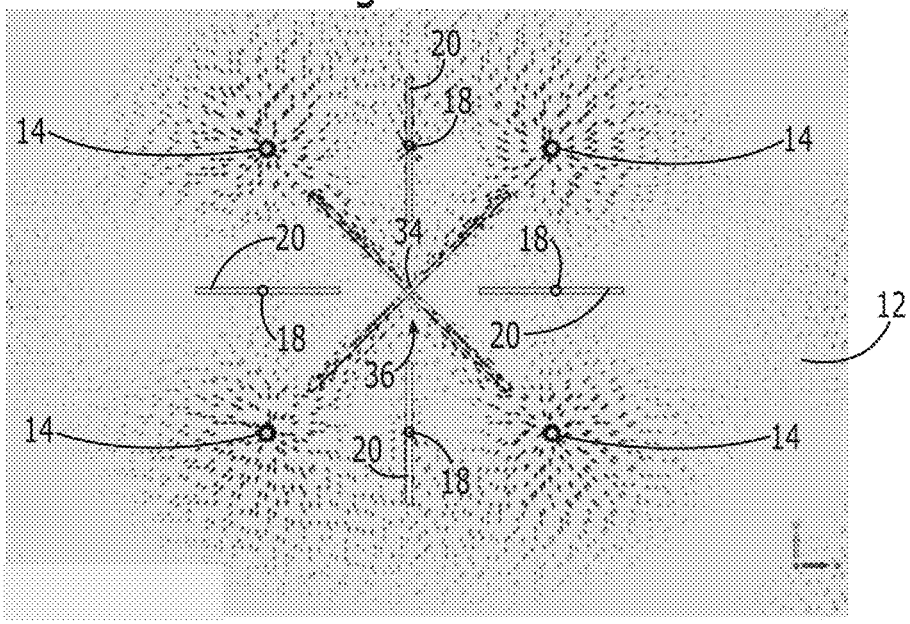
Figure 17:
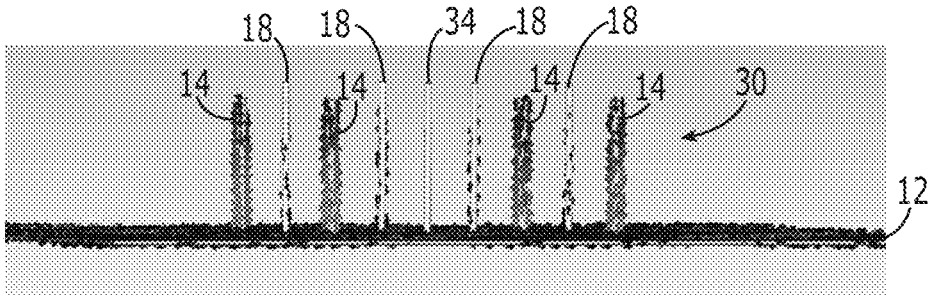
Figure 18:
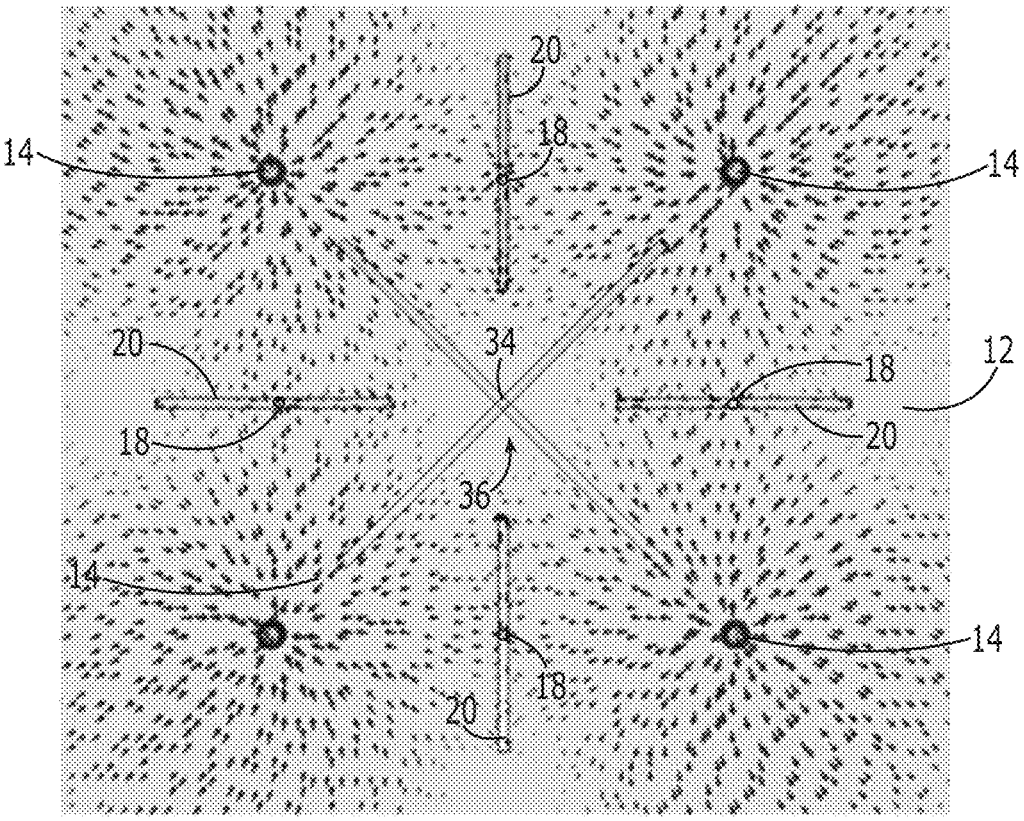
Figure 19:
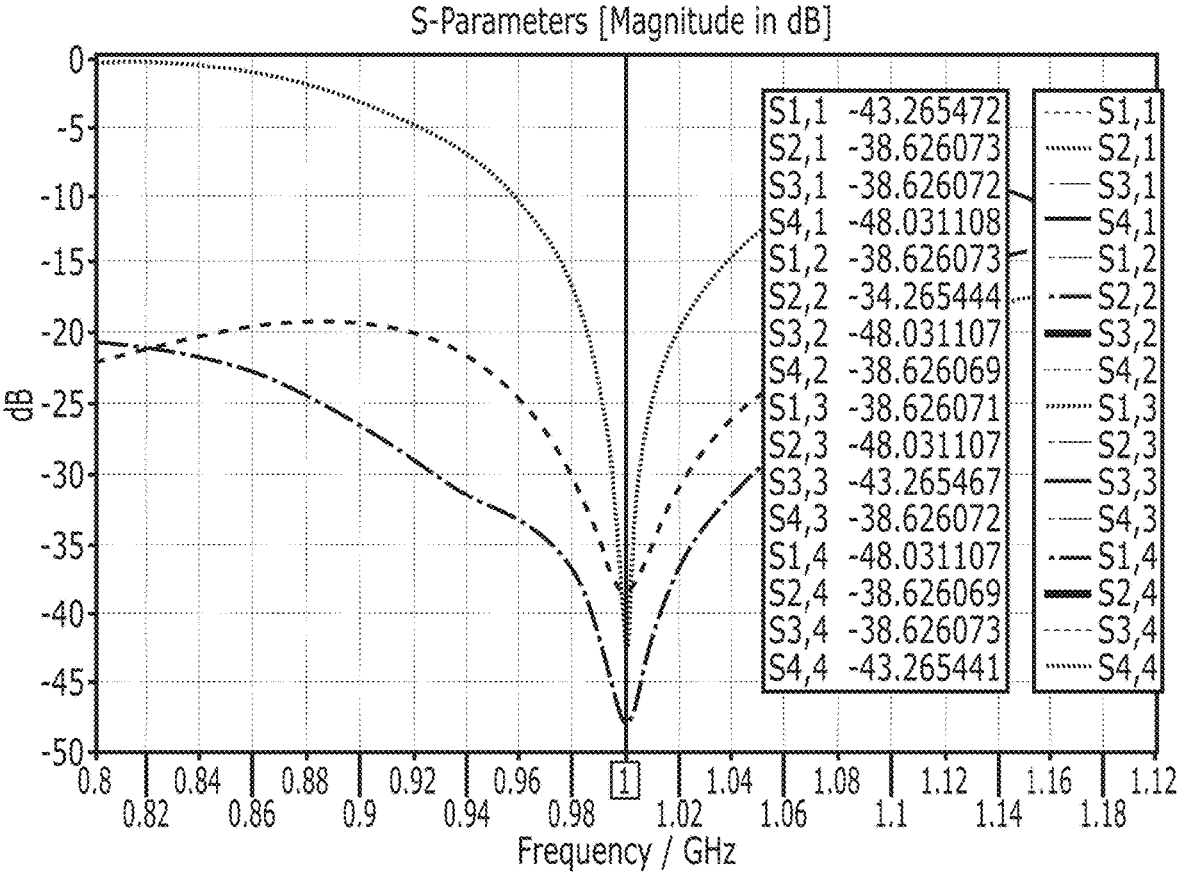
Figure 20:
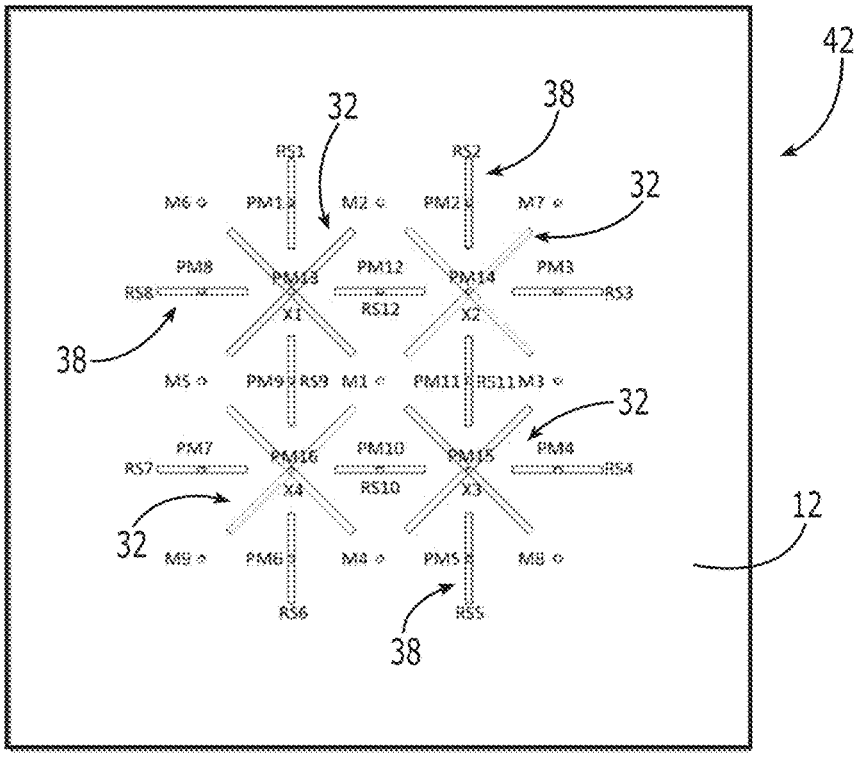
Figure 21:
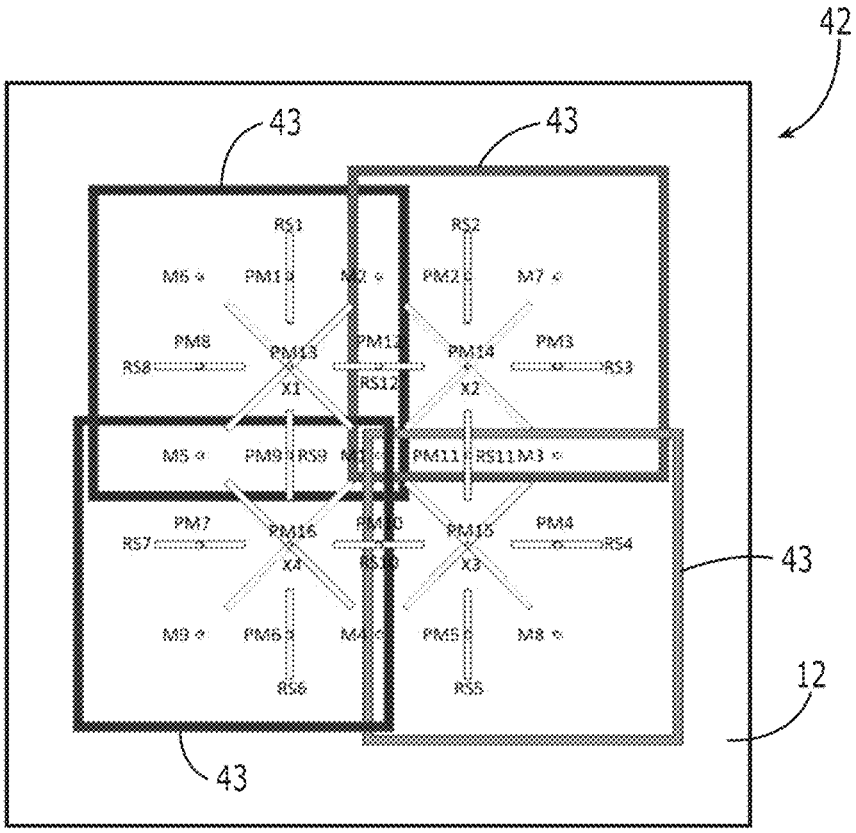
Figure 22:
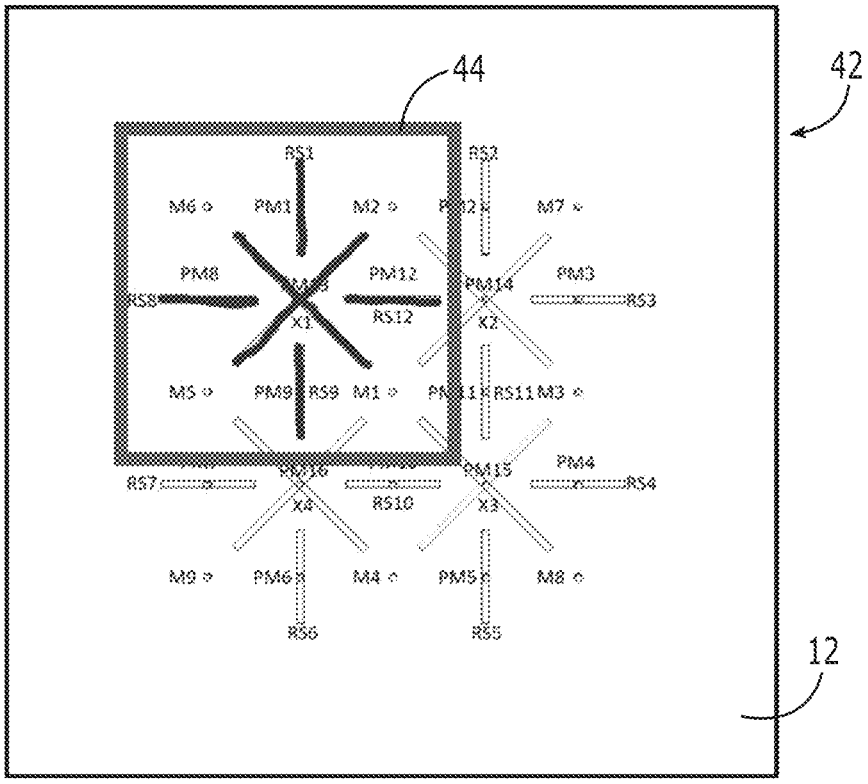
Figure 23:
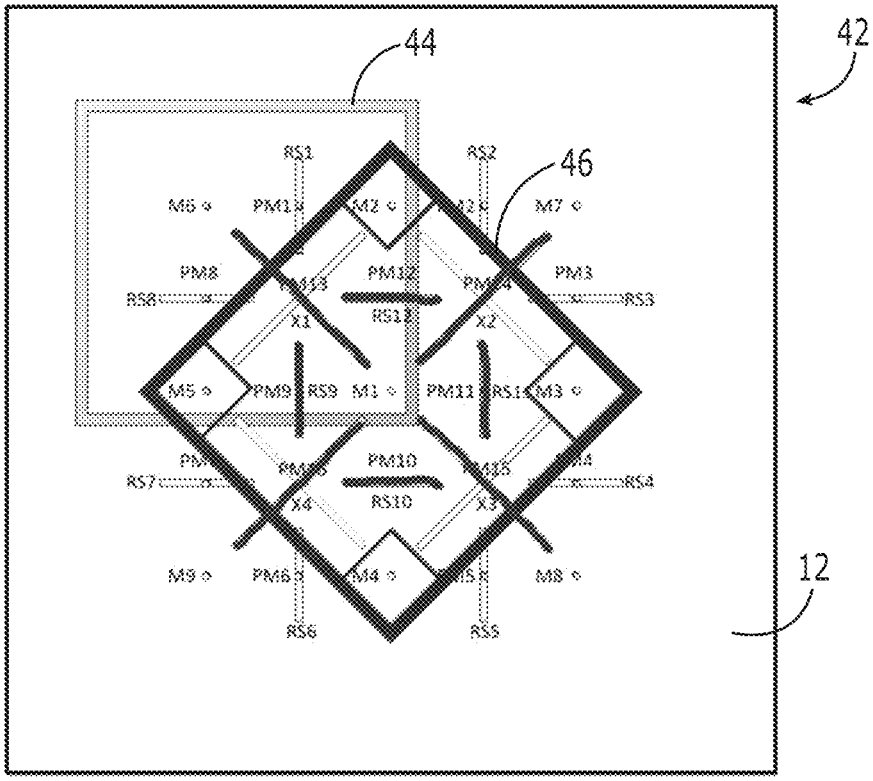
Figures 24, 25:
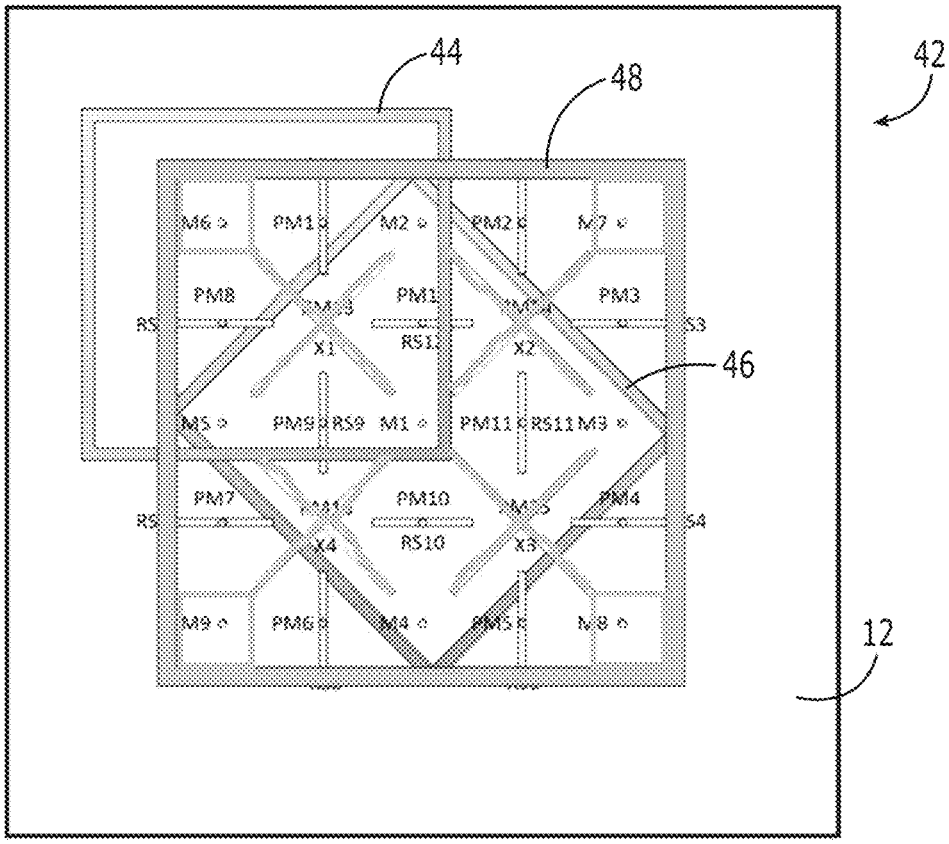
Figure 26:
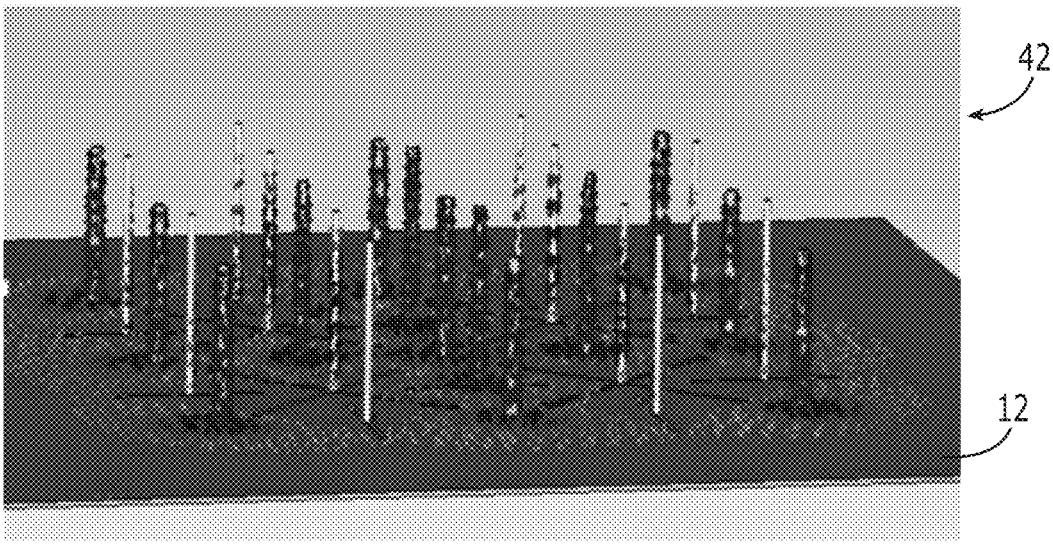
Figure 27:
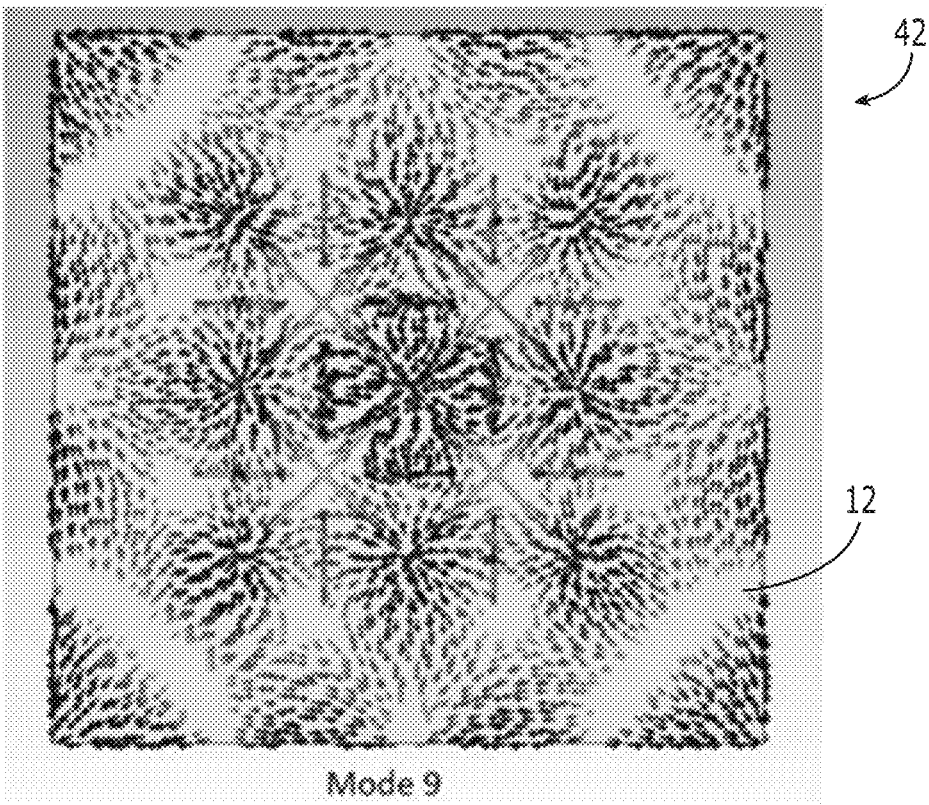
Figure 28:
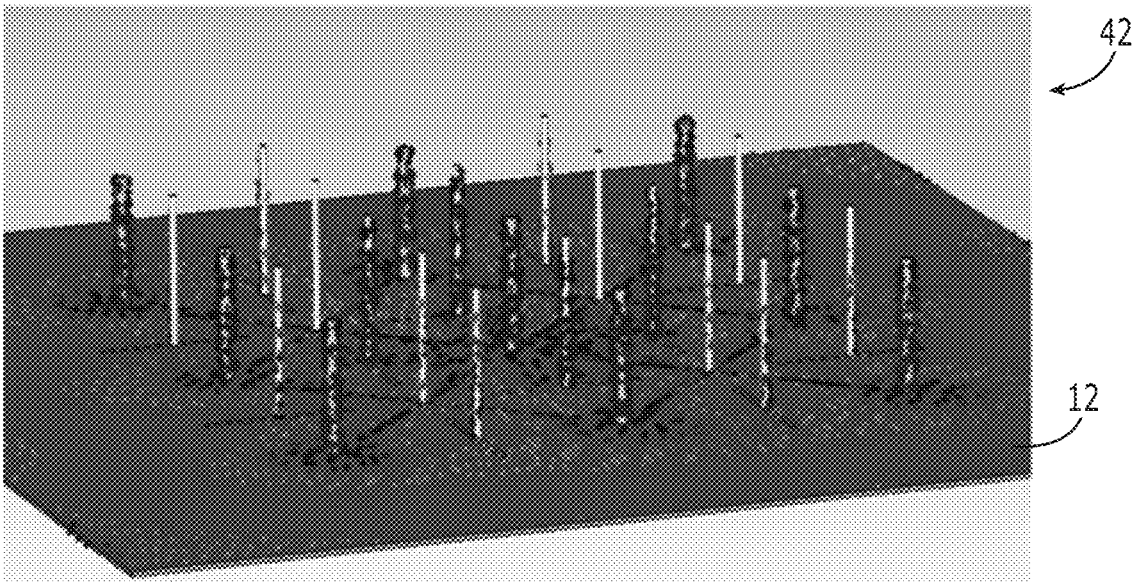
Figure 29:
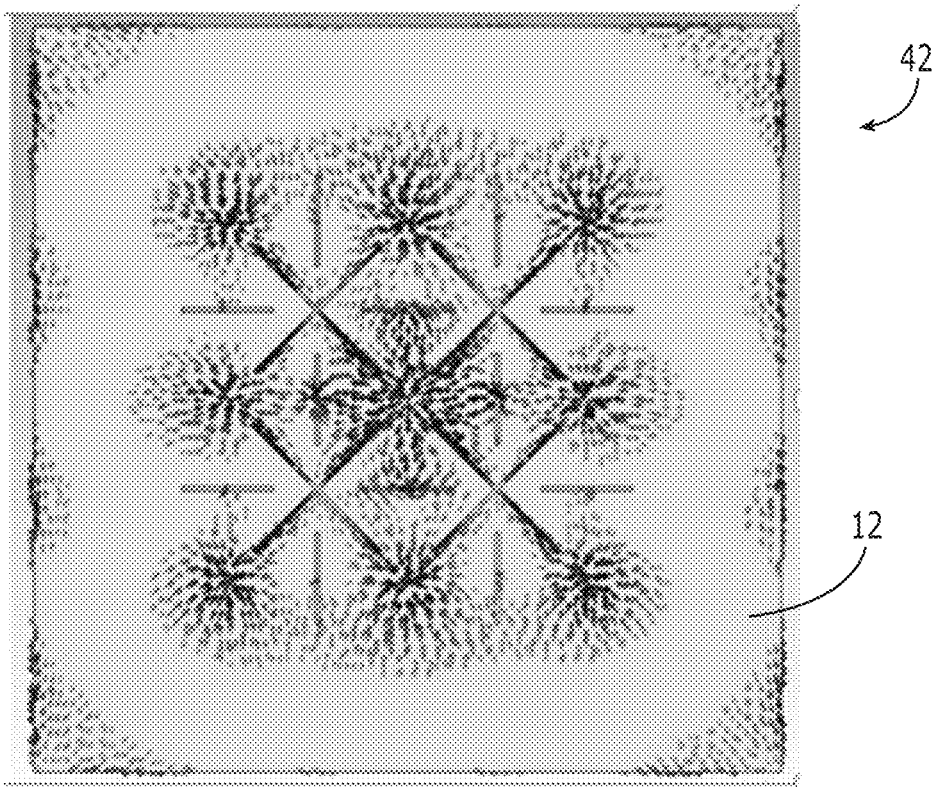
Figure 30:
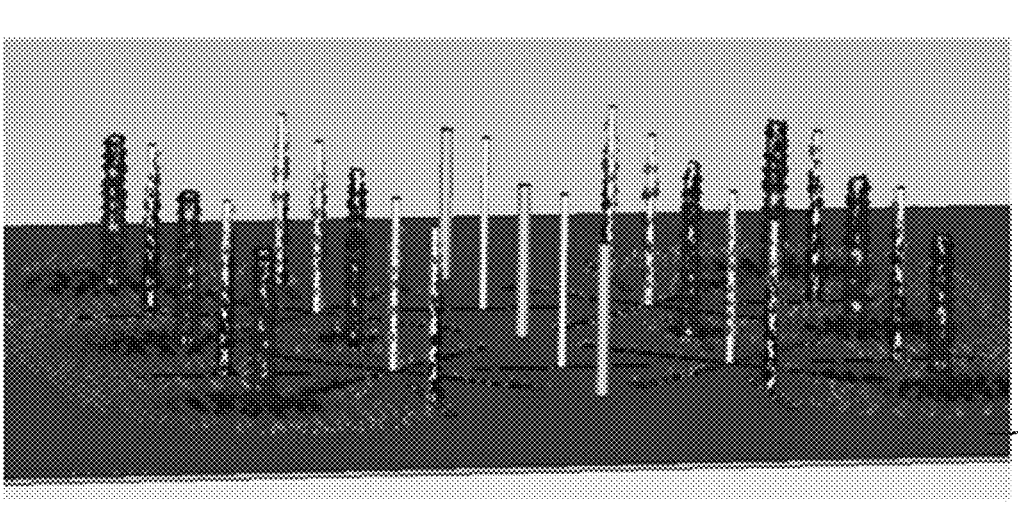
Figure 31:
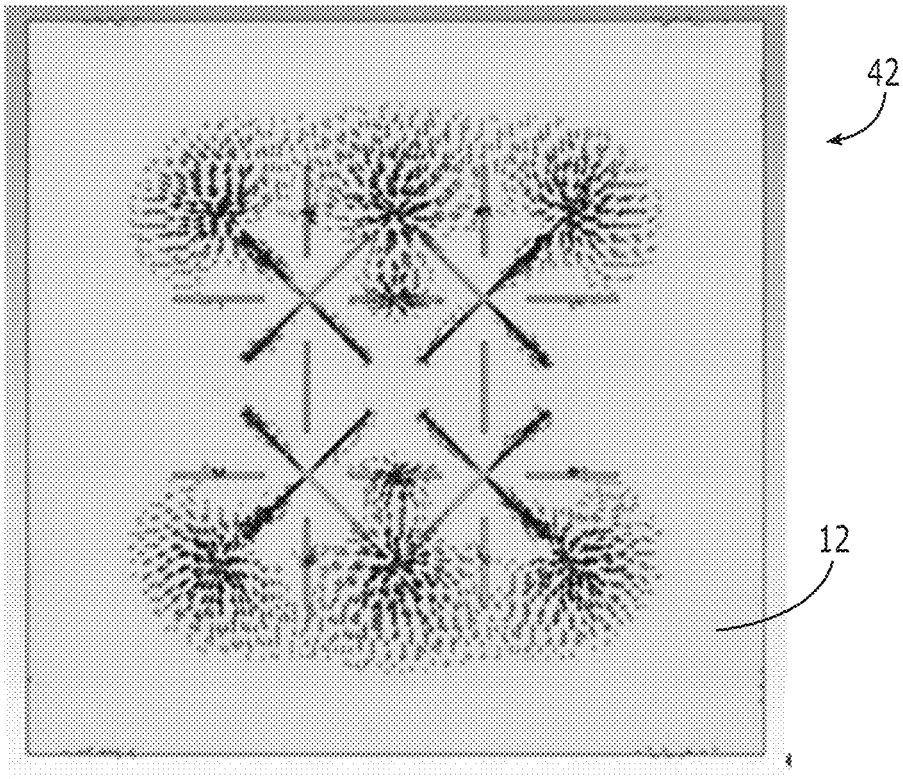
Figure 32:
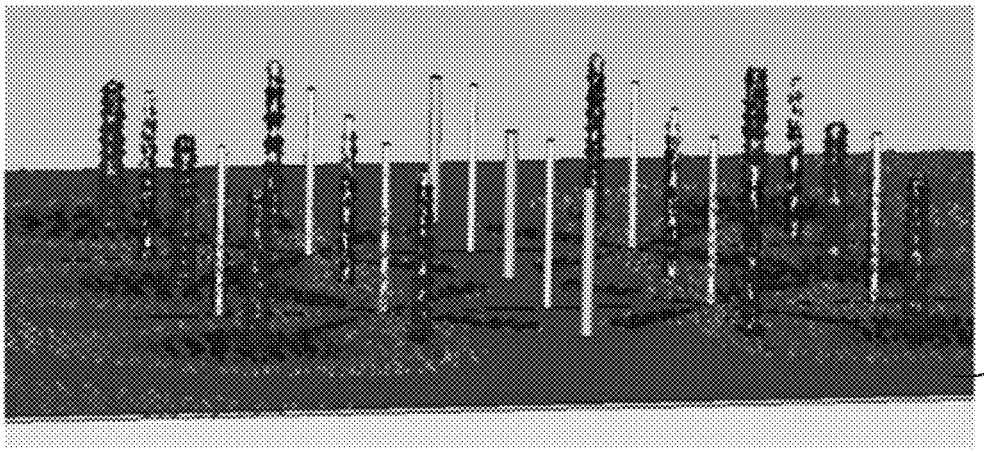
Figure 33:
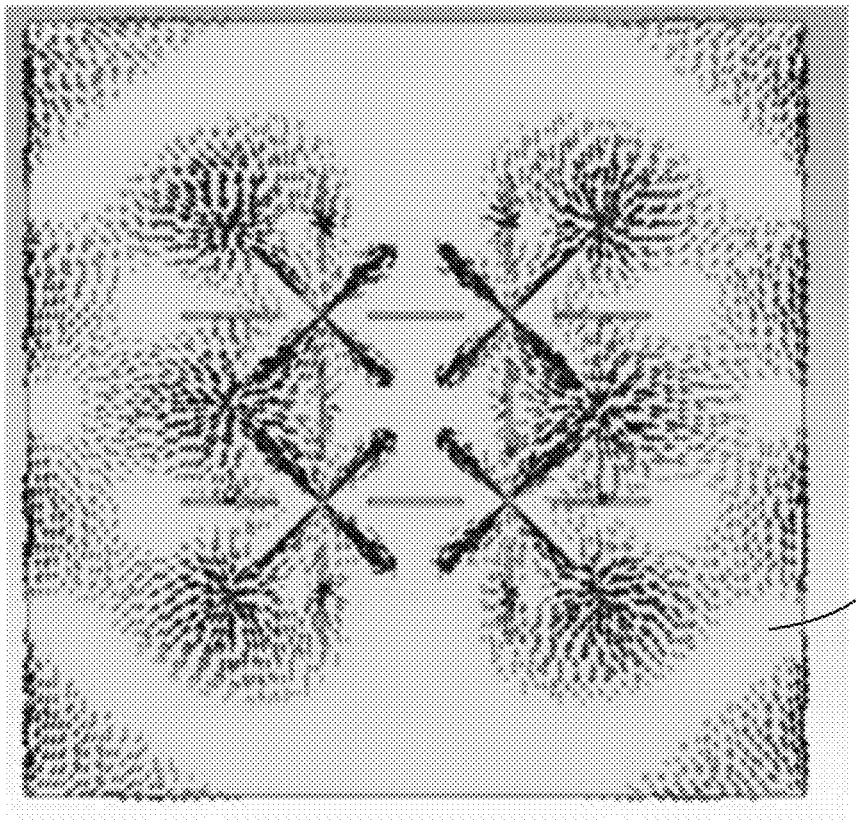
Figure 34:
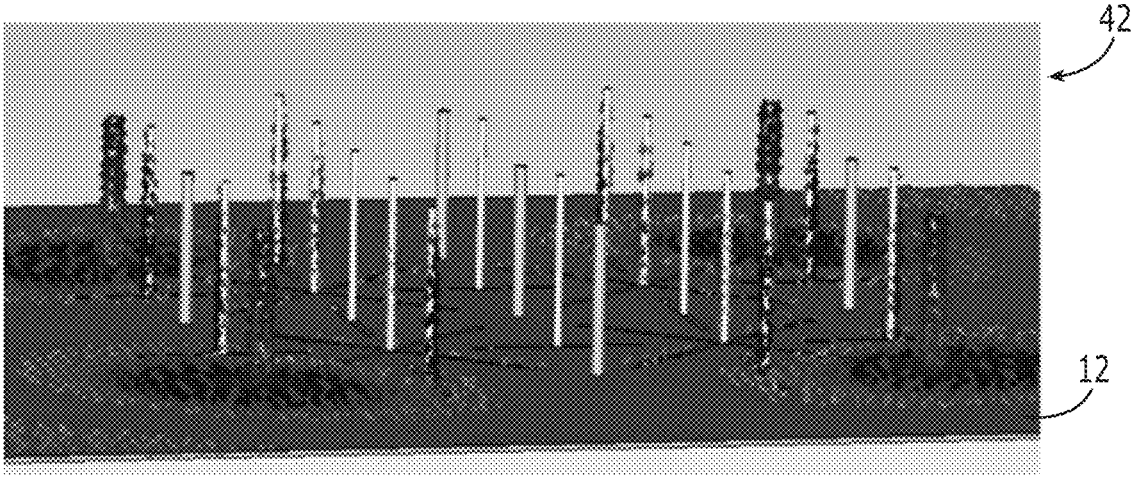
Figure 35:
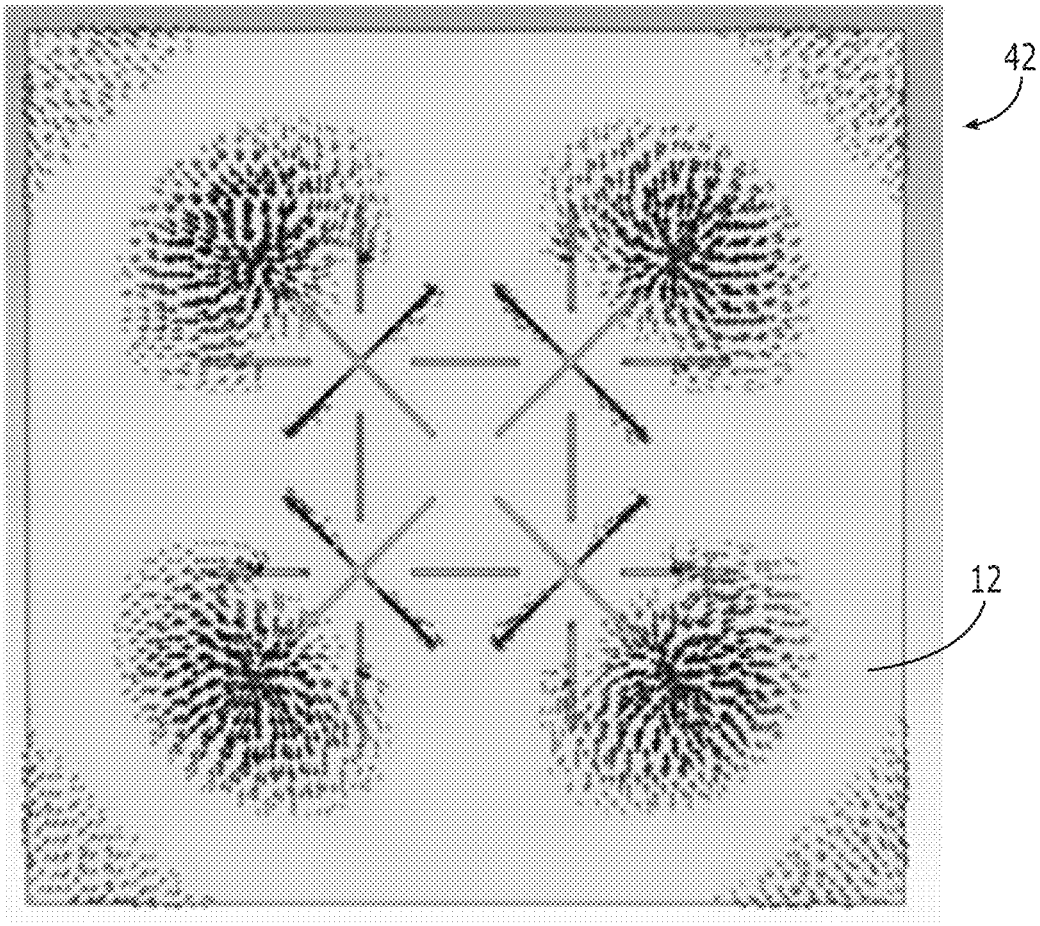
Figure 36:
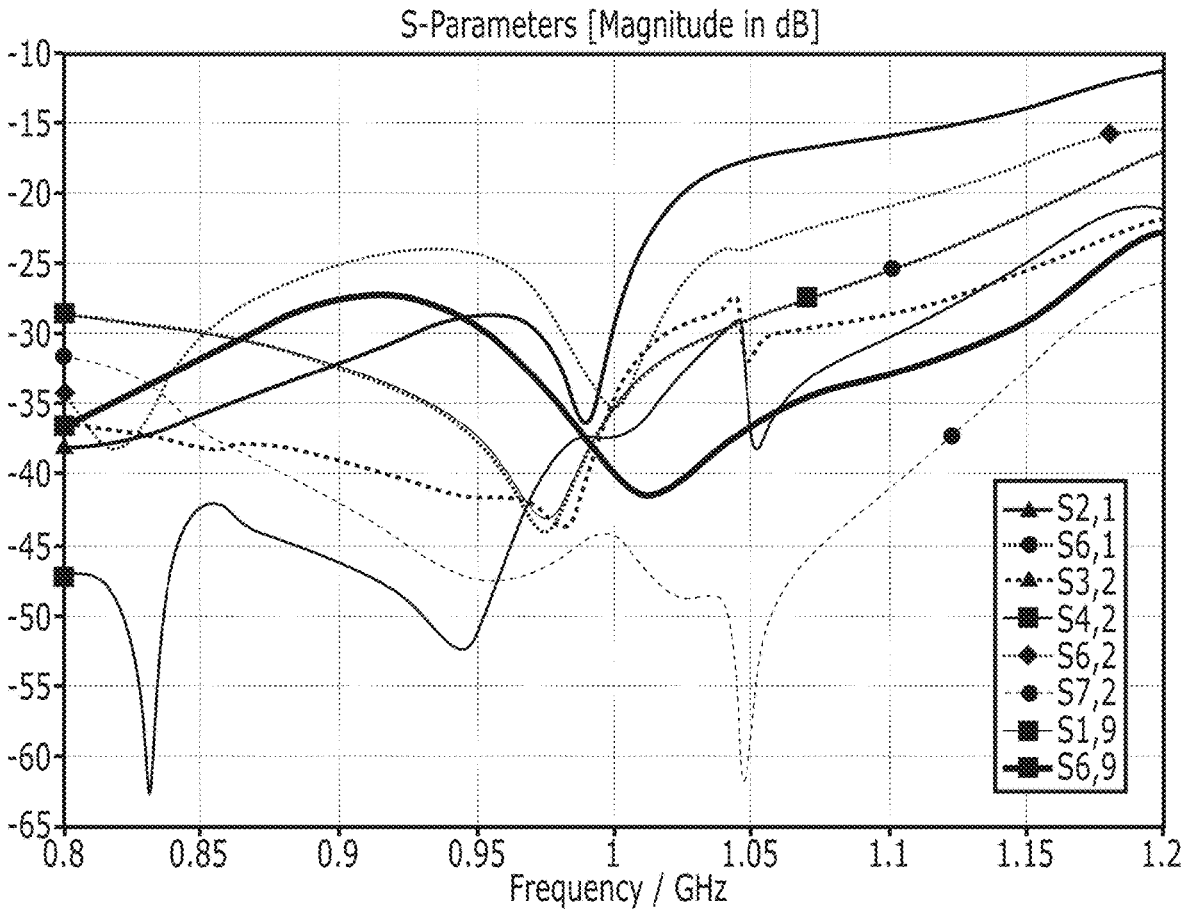
Figure 37:
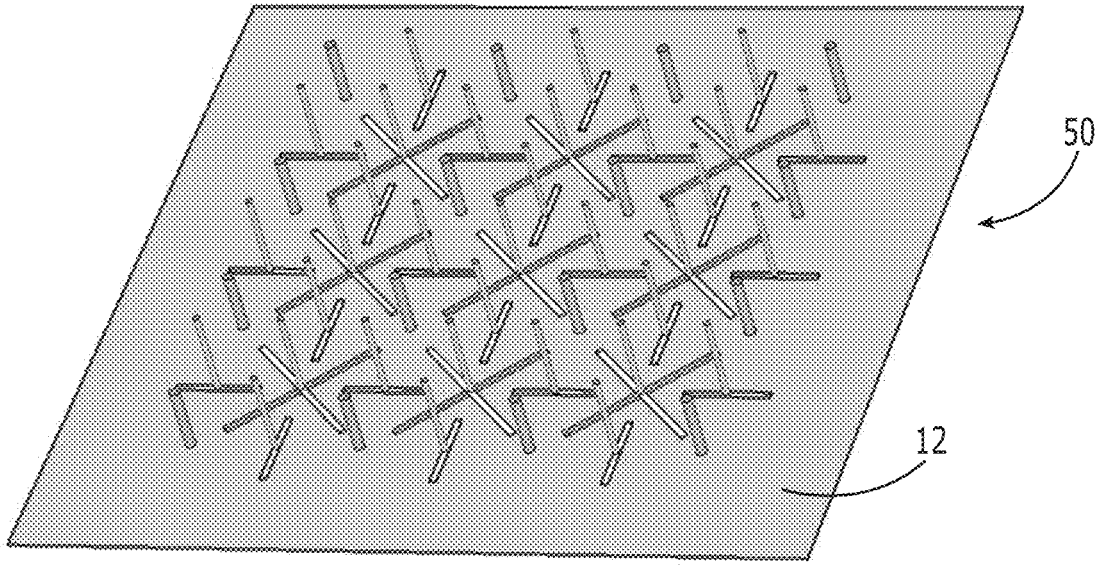

Having thus described certain example embodiments of the present disclosure in general terms, reference will hereinafter be made to the accompanying drawings which are not necessarily drawn to scale, and wherein:

FIG. 1 is a side view of an antenna of an example embodiment of the present disclosure;

FIG. 2 is a top view of the antenna of FIG. 1;

FIG. 3 is a side view of the surface current distribution of the antenna of FIGS. 1 and 2 while operating in an even mode;

FIG. 4 is a top view of the surface current distribution of the antenna of FIGS. 1 and 2 while operating in an even mode;

FIG. 5 is a side view of the surface current distribution of the antenna of FIGS. 1 and 2 while operating in an odd mode;

FIG. 6 is a top view of the surface current distribution of the antenna of FIGS. 1 and 2 while operating in an odd mode;

FIG. 7 is a perspective view of the antenna of FIGS. 1 and 2, which depicts various geometric parameters of the antenna;

FIG. 8 is a graphical representation of the S-parameters of the antenna of FIG. 7;

FIG. 9 is a side view of an antenna array of another example embodiment of the present disclosure;

FIG. 10 is a top view of the antenna array of FIG. 9;

FIG. 11 is a side view of the surface current distribution of the antenna array of FIGS. 9 and 10 while operating in mode 1;

FIG. 12 is a top view of the surface current distribution of the antenna array of FIGS. 9 and 10 while operating in mode 1;

FIG. 13 is a side view of the surface current distribution of the antenna array of FIGS. 9 and 10 while operating in mode 2;

FIG. 14 is a top view of the surface current distribution of the antenna array of FIGS. 9 and 10 while operating in mode 2;

FIG. 15 is a side view of the surface current distribution of the antenna array of FIGS. 9 and 10 while operating in mode 3;

FIG. 16 is a top view of the surface current distribution of the antenna array of FIGS. 9 and 10 while operating in mode 3;

FIG. 17 is a side view of the surface current distribution of the antenna array of FIGS. 9 and 10 while operating in mode 4;

FIG. 18 is a top view of the surface current distribution of the antenna array of FIGS. 9 and 10 while operating in mode 4;

FIG. 19 is a graphical representation of the S-parameters of the antenna array of FIGS. 9 and 10;

FIG. 20 is a top view of a 3×3 antenna array of another example embodiment of the present disclosure;

FIG. 21 is a top view of the 3×3 antenna array of FIG. 20 illustrating the construction of the 3×3 antenna array form the superposition of four 2×2 antenna arrays;

FIGS. 22-24 are top views of the 3×3 antenna array of FIG. 20 depicting three sets of 2×2 antenna arrays to combine to form the 3×3 antenna array;

FIG. 25 illustrates the nine orthogonal modes of the 3×3 antenna array of FIG. 20;

FIG. 26 is a side view of the surface current distribution of the antenna array of FIG. 20 while operating in mode 1;

FIG. 27 is a top view of the surface current distribution of the antenna array of FIG. 20 while operating in mode 9;

FIG. 28 is a side view of the surface current distribution of the antenna array of FIG. 20 while operating in mode 2;

FIG. 29 is a top view of the surface current distribution of the antenna array of FIG. 20 while operating in mode 2;

FIG. 30 is a side view of the surface current distribution of the antenna array of FIG. 20 while operating in mode 4;

FIG. 31 is a top view of the surface current distribution of the antenna array of FIG. 20 while operating in mode 4;

FIG. 32 is a side view of the surface current distribution of the antenna array of FIG. 20 while operating in mode 7;

FIG. 33 is a top view of the surface current distribution of the antenna array of FIG. 20 while operating in mode 7;

FIG. 34 is a side view of the surface current distribution of the antenna array of FIG. 20 while operating in mode 6;

FIG. 35 is a top view of the surface current distribution of the antenna array of FIG. 20 while operating in mode 6;

FIG. 36 is a graphical representation of the S-parameters of the antenna array of FIG. 20; and FIG. 37 is a perspective view of a 4×4 antenna array of another example embodiment of the present disclosure.

DETAILED DESCRIPTION

Some embodiments of the present disclosure will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout. As used herein, the terms "data," "content," "information," and similar terms may be used interchangeably to refer to data capable of being transmitted, received and/or stored in accordance with embodiments of the present disclosure. Thus, use of any such terms should not be taken to limit the spirit and scope of embodiments of the present disclosure.

In accordance with an example embodiment, an apparatus, such as an antenna and, more particularly, an antenna array and, even more particularly, a MIMO antenna array, is provided that includes a parasitic structure for providing mode balancing and reducing the adverse effects of mutual coupling. The antenna array may be configured to operate in various frequency bands and, in one embodiment, is configured to operate most efficiently with signals having wavelengths in the centimeter range. The antenna array may be included in various devices and in various settings. For example, the antenna array may be included in or with an electronic device, such as a base station or cell. The electronic device may be a base station cabinet, such as may be deployed adjacent to a tower, e.g., a base station tower, where the tower comprises an antenna array and cables (e.g., power and/or radio frequency (RF) transmission lines) interconnecting the base station cabinet to the antenna array, or an integrated base station unit (including the baseband, RF and other circuitry along with the antenna array).

Referring now to FIGS. 1 and 2, an apparatus, described hereinafter as an antenna 10 by way of example but not of limitation, is depicted. The antenna includes a ground plane 12, such as a finite ground plane, and first and second active radiators. As described below by way of example, but not of limitation, the first and second active radiators may be first and second active monopoles 14 positioned proximate to, such as above, the ground plane, but spaced from the ground plane. In an example embodiment in which the ground plane defines a reference plane, the first and second active monopoles extend outward from the ground plane in a direction perpendicular to the ground plane. However, the antenna of other example embodiments include other types of active radiators including but not limited to, first and second active dipoles such that the following description of an embodiment including first and second active monopoles is equally applicable to other types of active radiators.

The first and second active monopoles 14 are configured to be electrically coupled to a radio, such as a receiver, a transmitter and/or a transceiver. Thus, due to the electrical coupling between one or more radios and the first and second active monopoles, the first and second monopoles are said to be "active". In this regard, the first and second active monopoles of an example embodiment may each be electrically connected to a respective coaxial cable, the feed 15 of which is shown in FIG. 2. The feed is configured to transmit signals to and/or receive signals from a respective active monopole and, in an example embodiment, to interconnect the respective active monopole with a radio, such as a receiver, a transmitter and/or a transceiver. In another embodiment, the respective coaxial cable may, instead, be replaced by an alternative radio frequency transmission line, such as and not limited to at least one of: a microstrip line, a stripline, a coplanar waveguide, a slotline, coplanar strips, inverted microstrip, suspended microstrip, or a waveguide (e.g., rectangular or circular).

The first and second active monopoles 14 may be separated by various distances. In an example embodiment in which the antenna 10 is configured to operate at a predetermined resonant frequency, the first and second active monopoles may be separated by a distance equal to one-half of the wavelength at the predetermined resonant frequency. By way of example in which the predetermined resonant frequency is 1 GHz, the first and second active monopoles may be separated by 150 millimeters, that is, one-half of the wavelength at 1 GHz. However, the first and second active monopoles may be separated by different distances in other embodiments. For example, the first and second active monopoles may be separated by a distance as small as 1/10 of the wavelength at the predetermined resonant frequency while still enjoying the benefits of the parasitic structure as described below.

The antenna 10 of this example embodiment also includes a parasitic structure 16 for reducing the mutual coupling. The parasitic structure includes a grounded radiator. As described below by way of example, but not of limitation, the grounded radiator may be a grounded monopole 18 electrically coupled to the ground plane 12 and positioned between the first and second active monopoles 14. However, the antenna 10 of other example embodiments include other types of grounded radiators such that the following description of an embodiment including a grounded monopole is equally applicable to other types of grounded radiators.

In an example embodiment in which the ground plane 12 defines a reference plane, the grounded monopole 18 extends outward from the ground plane in a direction perpendicular to the ground plane. In addition, unlike the first and second active monopoles 14 that are electrically connected via a feed 15 to a radio, the grounded monopole is not connected to a feed that, in turn, is connected to a radio, but one end of the grounded monopole is, instead, connected, such as by galvanic coupling, to the ground plane. In this regard, the grounded monopole serves as a parasitic structure by interacting with the first and second active monopoles via the ground plane and/or otherwise through the environment, e.g., through the air surrounding the monopoles. In an example embodiment shown in FIG. 1 in which the first and second active monopoles are spaced apart from one another along a reference line 14*a*, the grounded monopole is positioned along the reference line at a midpoint between the first and second active monopoles.

The parasitic structure 16 of this example embodiment also includes a non-conductive slot 20 defined by the ground plane 12. The non-conductive slot 20 defined by the ground plane 12 is formed by the removal of conductive ground plane material, where the ground plane 12 may be provided by a sheet of conductive material, for example, metal. Alternatively, the ground plane may be formed in the first instance so as to define the non-conductive slot. The non-conductive slot 20 may be filled with only air, only with a dielectric material or any combination of air and a dielectric material. Dielectric materials may be, and are not limited to, at least one of: FR4 (commonly used printed circuit board dielectric substrate material, usually a glass-reinforced epoxy laminate material or woven Teflon fiberglass laminate), microfibre Teflon fiberglass, high dielectric ceramic filled Teflon glass, alumina, sapphire, quartz, ceramic or beryllia. In an embodiment in which the non-conductive slot 20 is at least partially filled with a dielectric material, the dielectric material may be homogeneous in structure, or alternatively heterogeneous in structure using one or more materials, one of which may be air.

As shown in FIG. 2, the non-conductive slot 20 is also positioned between the first and second active monopoles 14 and is bounded on opposed side edges and opposed end edges by the ground plane, such that the ground plane fully encloses the slot. The slot of an example embodiment is a rectangular slot. However, the slot may have other shapes, such as an elliptical shape, a curved shape, a fractal shape or the like. The slot of an example embodiment extends in opposite directions from the grounded monopole 18. For example, the slot of the embodiment depicted in FIG. 2 extends in equal distances in the opposite directions from the grounded monopole such that the grounded monopole is centrally disposed relative to the slot, that is, the grounded monopole is disposed at the midpoint of the slot as measured between the opposed end edges of the slot. The grounded monopole of an example embodiment is not only centrally disposed relative to the slot, but extends through the slot and outward from the ground plane. In the example embodiment of FIG. 2 in which the first and second active monopoles are spaced apart from one another along the reference line 14*a*, the rectangular slot is oriented relative to the reference line so as to have a width in a direction parallel to the reference line and a length in a direction perpendicular to the reference line. Thus, the rectangular slot generally extends perpendicular to the reference line since the length of the slot is substantially greater than the width of the slot.

In the embodiment in which the grounded monopole 18 is disposed within the non-conductive slot 20, one end of the grounded monopole may be galvanically coupled to the ground plane 12, such as on one or both opposed sides of the slot, thereby providing for the electrical connection of the grounded monopole to the ground plane. The connection of the grounded monopole to the ground plane may be provided by a solder joint, a connector or some other means of joining the metallic materials together that form the ground plane and the grounded monopole.

The antenna 10 of FIG. 1 supports two orthogonal modes, namely, an even mode and an odd mode. In the even mode, the first and second active monopoles 14 are fed in phase, while in the odd mode, the first and second active monopoles are fed out of phase. In accordance with an example embodiment, the parasitic structure 16 is configured to balance these two orthogonal modes, that is, by matching the resonant frequencies and the radiating bandwidth. In this regard, FIGS. 3 and 4 depict the surface current distribution in the even mode of operation of the antenna having the first and second active monopoles above a finite ground plane 12. As shown in FIGS. 3 and 4, only the grounded monopole 18 interacts with the surface current distribution in the even mode of operation. In contrast, FIGS. 5 and 6 depict the surface current distribution of the antenna of FIGS. 1 and 2 in the odd mode of operation. In this example embodiment, FIGS. 5 and 6 illustrate that only the slot 20, e.g., the rectangular slot, of the parasitic structure interacts with the surface current distribution in the odd mode of operation.

Although the antenna 10 of this example embodiment may be configured in various manners, the antenna of an example embodiment and its geometric parameters are depicted in more detail in FIG. 7 in which the parasitic structure 16 including the grounded monopole 18 and the slot 20 balance the two orthogonal modes of operation of the antenna including the first and second active monopoles 14 above the finite ground plane 12. In this example embodiment, d1 and d2 are the diameter of the first and second active monopoles, respectively, while h1 and h2 are the length of the first and second active monopoles, respectively. d_gap is the width of the gap between the bottom of the first and second active monopoles and the ground plane. In this regard, the gap is the distance between the ground plane and a respective active monopole with the feed, such as a coaxial input pin, physically and electrically contacting the bottom of the respective active monopole. For example, the feed may extend through an aperture defined by the ground plane and into contact with the respective active monopole. In an example embodiment, the gap is configured to match the respective active monopole to impedance of the feed, e.g., the coaxial port, at the resonant frequency. W and L are the width and length, respectively, of the ground plane. Further, w1 and l1 are the width and length, respectively, of the rectangular slot, while d_outer and d_inner are the diameters of the outer and inner conductors, respectively, of the coaxial feed and d_coax is the length of the coaxial feed. Although the antenna may be configured with various geometric parameters, the geometric parameters of one example embodiment of an antenna are as follows:

| |
|---|
| W = 343.677 mm |
| L = 458.237 mm |
| d_inner = 1.942 mm |
| d1/d outer = 4.970 |
| d2/w1 = 3.348 |
| d_coax = 15 mm |
| h1 = 69.229 mm |
| h2 = 75.512 mm |
| d_gap = 0.690 mm |
| I1 = 75.512 mm |

For an antenna 10 having the foregoing parameters, the isolation level between the input ports for the first and second active monopoles 14 is above 60 dB at 1 GHz and above 25 dB across the bandwidth of the antenna. In this regard, the simulated S parameter of an antenna having the foregoing geometric parameters is depicted in FIG. 8. The S parameter describes the response of the two-port antenna to signals incident to either or both ports. The first number in the S parameter subscript refers to the responding port, while the second number of the S parameter subscript refers to the incident port.

Referring now to FIGS. 9 and 10, a side view and a top view of an apparatus, such as an antenna array 30, in accordance with an example embodiment is depicted. The antenna array includes the ground plane 12 and a plurality of active monopoles 14 positioned proximate to, such as above, the ground plane, but spaced from the ground plane, such as by a gap as noted above. Each active monopole may be electrically coupled to at least one of a receiver, a transmitter and/or a transceiver. In this regard, each active monopole may be communicably coupled to a coaxial cable, the feed 32 of which is shown in FIG. 9, to transmit signals to and/or receive signals from the respective active monopole. In the example embodiment, the plurality of active monopoles include first, second, third and fourth active monopoles arranged in a 2×2 antenna array. In one example embodiment, the active monopoles arranged in a square configuration as shown in the top view of FIG. 10. As noted above, the active monopoles may be spaced apart by any of various separation distances, but, in one embodiment, are spaced apart by a separation distance equal to half of the wavelength at the resonant frequency of the antenna array, such as a separation distance of 150 millimeters for an antenna array intended to operate at 1 GHz. However, the separation distance between neighboring active monopoles may be reduced, such as to ¼ of the wavelength at the resonant frequency of the antenna array while still providing for the benefits attributable to the parasitic structures described below.

The apparatus, such as the antenna array 30, of this example embodiment also includes a first parasitic structure 32 including a first grounded monopole 34 electrically coupled to the ground plane 12 and centrally disposed relative to the plurality of active monopoles 14, such as by being centrally disposed relative to the first, second, third and fourth active monopoles of the embodiment of FIGS. 9 and 10. For example, the first grounded monopole may be located at the center of the square defined by first, second, third and fourth active monopoles. The first parasitic structure of this example embodiment also includes a non-conductive cross-shaped slot 36 defined by the ground plane and centrally disposed relative to the plurality of active monopoles, such as by being centrally disposed relative to the first, second, third and fourth active monopoles of the antenna array of FIGS. 9 and 10. The cross-shaped slot is enclosed by the ground plane which borders the cross-shaped slot along each side edge and end edge. The cross-shaped slot can be considered the superposition of two slots, such as two rectangular slots. Thus, the combination of the first grounded monopole and the cross-shaped slot of the first parasitic structure can be viewed as a result of self-repeating the parasitic structure of the antenna 10 of FIGS. 1 and 2, such as the grounded monopole 18 and the slot 20 of the parasitic structure of the embodiment of FIGS. 1 and 2.

As shown in FIG. 10, the cross-shaped slot 36 includes first and second slot components 36*a* oriented so as to intersect one another at a medial portion thereof, thereby defining an X configuration. More particularly, the cross-shaped slot of an example embodiment is configured such that the first and second slot components intersect one another at a point of intersection located midway along each of the first and second slot components. Like the grounded monopole 34 of this example embodiment depicted in FIG. 10, the point of intersection of the first and second slot components of the cross-shaped slot is positioned at the center of the square defined by the first, second, third and fourth active monopoles 14. The cross-shaped slot of an example embodiment is configured such that the first and second slot components are perpendicularly oriented relative to one another. With respect to the orientation of the slot components of the cross-shaped slot, each of the slot components of an example embodiment is aligned with and extends along the line between two of the active monopoles. In this regard, for an antenna array 30 as depicted in FIG. 10 including first, second, third and fourth active monopoles arranged in a square configuration, the first slot component is configured so as to extend along one diagonal of the square, while the second slot component is configured to extend along the other diagonal of the square. Thus, each slot component of this example embodiment is aligned with and extends along a line between a pair of diagonally opposed active monopoles.

In the illustrated embodiment, the first grounded monopole 34 extends through the cross-shaped slot 36 at the point of intersection. Thus, the first grounded monopole of this example embodiment is located at the center of the plurality of active monopoles 14, such as the first, second, third and fourth active monopoles.

In addition to the first parasitic structure 32, the apparatus, such as the antenna array 30, of this example embodiment also includes a second parasitic structure 38 including a second grounded monopole 18 electrically coupled to the ground plane 12 and positioned between two of the neighboring active monopoles 14, such as between the first and second active monopoles. The second parasitic structure also includes a non-conductive slot 20, such as a non-conductive rectangular slot, defined by the ground plane and positioned between the pair of neighboring active monopoles, such as between the first and second active monopoles. As described above, the rectangular slot of the second parasitic structure extends in equal and opposite directions from the second grounded monopole with the second grounded monopole extending through the slot.

In an embodiment in which the pair of neighboring active monopoles 14, such as the first and second active monopoles, are spaced apart from one another along a reference line 14*a*, the rectangular slot 20 is oriented relative to the reference line so as to have a width in a direction parallel to the reference line and a length in a direction perpendicular to the reference line. As the length of the slot is generally significantly greater than the width of the slot, the slot extends perpendicularly to the reference line. As described above in relation to the embodiment of FIGS. 1 and 2, the second grounded monopole 18 and the slot of the second parasitic structure 38 may be positioned at a midpoint between the first and second active monopoles. Thus, as shown in FIG. 10, the direction that is perpendicular to the reference line at the midpoint between the first and second active monopoles also intersects the first grounded monopole 34 at the center of the first, second, third and fourth active monopoles. In other words, the center line 20*a*, 20*b* of the slot extending between the opposed end portions also extends through both the second grounded monopole of the second parasitic structure and the first grounded monopole 34 of the first parasitic structure 32.

In an example embodiment, the apparatus, such as the antenna array 30, includes a plurality of second parasitic structures 38, one of which is positioned between each pair of neighboring active monopoles 14. For example, second parasitic structures may be placed between the first and second active monopoles as described above, between the second and third active monopoles, between the third and fourth active monopoles and between the first and fourth active monopoles, as shown in FIGS. 9 and 10. In an embodiment in which the active monopoles of the antenna array are positioned in a square, the slots 20 of the second parasitic structures on opposite sides of the cross-shaped slot 36 are collinear and are aligned along the same reference line as shown in the embodiment of FIG. 10. For example, the slot of the second parasitic structure between the first and second active monopoles and the slot of the second parasitic structure between the third and fourth active monopoles lie along a first center line 20*a*, while the slot of the second parasitic structure between the second and third active monopoles and the slot of the second parasitic structure between the first and fourth active monopoles lie along a second center line 20*b*, which is perpendicular to the first reference line.

A 2×2 antenna array 30 as shown in FIGS. 9 and 10 has four orthogonal modes designated mode 1, mode 2, mode 3 and mode 4. In mode 1, the first, second, third and fourth active monopoles 14 are all fed in phase. In mode 2, the first and second active monopoles are fed in phase and the third and fourth active monopoles are fed out of phase. In mode 3, the first and fourth active monopoles are fed in phase and the second and third active monopoles are fed out of phase. Finally, in mode 4, the first and third active monopoles are fed in phase and the second and fourth active monopoles are fed out of phase. The parasitic structures 32, 38 of this example embodiment balance the four orthogonal modes, such as by matching the resonant frequencies and radiating bandwidth, as a result of the interaction of different modes of operation with different combinations of the parasitic elements.

By way of example, FIGS. 11 and 12 illustrate the surface current distribution of mode 1 of a 2×2 antenna array 30 having four active monopoles 14 above a finite ground plane 12 as shown in FIGS. 9 and 10. As shown in FIGS. 11 and 12, each of the grounded monopoles 18, 34 of the first and second parasitic structures 32, 38 interact in mode 1, but the slots 20, 36 do not contribute to the interaction. In contrast, FIGS. 13 and 14 illustrate the surface current distribution in mode 2 of the 2×2 antenna array having four active monopoles above a finite ground plane. As shown in FIGS. 13 and 14, two of the second grounded monopoles designated grounded monopoles 5 and 7 and two of the slots 20 designated slots 2 and 4 as well as the cross-shaped slot interact in mode 2, but not the other components of the parasitic structures. As such, a subset of the second grounded monopoles and a subset of the slots interact, along with the cross-shaped slot, in mode 2 with the second grounded monopoles and the slots that interact being components of different second parasitic structures 38.

FIGS. 15 and 16 illustrate the surface current distribution in mode 3 of a 2×2 antenna array 30 having four active monopoles 14 above a finite ground plane 12. As shown in FIGS. 15 and 16, two of the second grounded monopoles 18 designated grounded monopoles 6 and 8 and two of the slots 20 designated slots 1 and 3 as well as the cross-shaped slot 36 interact in mode 3, but not the other components of the parasitic structures. As such, a subset of the second grounded monopoles and a subset of the slots interact, along with the cross-shaped slot, in mode 3 with the second grounded monopoles and the slots that interact being components of different second parasitic structures 38. Further, FIGS. 17 and 18 illustrate the surface current distribution in mode 4 of a 2×2 antenna array having four active monopoles above a finite ground plane. As shown in FIGS. 17 and 18, each of the slots 20 of the second parasitic structures interact in mode 4, but neither the cross-shaped slot nor the grounded monopoles 18, 34 contribute to the interaction.

In this example embodiment of an antenna array 30, the first and second parasitic structures 32, 38 including the cross-shaped slot 36 and first grounded monopole 34 of the first parasitic structure and the second grounded monopoles 18 and slots 20 of the second parasitic structures are configured to balance the four orthogonal modes of the 2×2 antenna array. In an example embodiment, the isolation level between the input ports for the first, second, third and fourth active monopoles 14 may be above 35 dB at 1 GHz and above 25 dB across the bandwidth of the antenna array. In addition, the simulated S parameters of this example embodiment are depicted in FIG. 19.

The antenna array can include larger numbers of active monopoles 14 and, as such, larger numbers of parasitic structures. For example, the antenna array may include a plurality of active monopoles arranged in a 3×3 array, a 4×4 array or larger arrays. In a 3×3 array as shown in FIG. 20, the antenna array 42 includes a plurality of first parasitic structures 32, each of which includes a first grounded monopole 34 electrically coupled to the ground plane 12 and a non-conductive cross-shaped slot 36 defined by the ground plane. Each first parasitic structure is centrally disposed with respect to four neighboring active monopoles of the 3×3 array. In the example of FIG. 20, the active monopoles are designated as M1-M9 and are connected to separate coaxial feeds. The antenna array of FIG. 20 includes twelve second parasite structures 38, each including a second grounded monopole 18 designated PM1-PM12 and a slot 20, such as a rectangular slot, designated RS1-RS12. The antenna array of the example embodiment also includes four first parasitic structures 32, each including a cross-shaped slot designated X1-X4 and a first grounded monopole designated PM13-PM16.

Thus, as shown in FIG. 21, the antenna array 42 of this example embodiment includes four 2×2 antenna arrays 43, as described above with respect to the embodiment of FIGS. 9 and 10. For example, one 2×2 antenna array is formed by the active monopoles M1, M2, M5 and M6, a second 2×2 antenna array includes active monopoles M1, M2, M3 and M7, a third 2×2 antenna array includes active monopoles M1, M4, M5 and M9, while a fourth 2×2 antenna array includes M1, M3, M4 and M8. The superposition of each of these 2×2 antenna arrays results in a 3×3 antenna array 42 as shown in FIGS. 20 and 21. The resulting 3×3 antenna array includes a first parasitic element 32 having a first grounded monopole 34 and a cross-shaped slot 36 and four second parasitic structures 38, each having a second grounded monopole 18 and a slot 20, such as a rectangular slot, as described above.

Alternatively, to illustrate the self-repeating pattern of the parasitic structures, the 3×3 antenna array 42 may be viewed as an antenna array that includes three sets 44, 46, 48 of 2×2 antenna arrays. FIGS. 22-24 illustrate each set of 2×2 antenna arrays with its corresponding parasitic structures. As FIGS. 22-24 depict, a self-repeating pattern exists for the parasitic structures of the 3×3 antenna array.

A 3×3 antenna array 42 has nine orthogonal modes as illustrated in FIG. 25. In this regard, a plus sign (+) represents the antenna feed being in phase, a dash (−) represents the antenna feed being out of phase, and a zero represents an active monopole 14 having no input signal. As illustrated by FIG. 25, modes 2 and 3, modes 4 and 5 and modes 7 and 8 are three sets of degenerate modes. As such, there are only six modes that need to be independently balanced due to three pairs of modes having mutual 90 degree rotational symmetry. By way of example, modes 2 and 3, modes 4 and 5 and modes 7 and 8 are three pairs of degenerate modes that have mutual 90 degree rotational symmetry, e.g., the rotation of mode 2 by 90 degrees coincides with mode 3 and vice versa.

FIGS. 26-35 depict side and top views of the surface current distributions of the 3×3 antenna array 42 in various modes of operation. In this regard, FIG. 26 depicts the surface current distribution of mode 1 in a side view. As shown in FIG. 26, mode 1 interacts with all of the first and second grounded monopoles designated PM1-16. This interaction is primarily with the second grounded monopoles 18 designated PM9-12 of the second parasitic structures, then with the first grounded monopoles 34 designated PM13-16 in an intermediate amount and finally with the second grounded monopoles designated PM1-8 in a lesser amount. As shown in the top view of FIG. 27, mode 9 interacts with the slots 20 designated RS1-12 of the second parasitic structures, primarily by interacting with the slots designated RS9-12.

FIGS. 28 and 29 illustrate side and top views, respectively, of the surface current distribution of the 3×3 antenna array 42 in mode 2, while FIGS. 30 and 31 illustrate the side and top views, respectively, of the surface current distribution of the 3×3 antenna array in mode 4. Further, FIGS. 32 and 33 illustrate side and top views, respectively, of the surface current distribution of the 3×3 antenna array in mode 7. FIGS. 34 and 35 illustrate side and top views, respectively, of the surface current distribution of the 3×3 antenna array in mode 6. In this regard, mode 6 is shown to interact with one of the slot components 36*a* of each cross-shaped slot 36 designated X1-4 and with the second grounded monopoles 18 designated PM1-8 of the second parasitic structures 38. Further, modes 2 and 3, modes 4 and 5 and modes 7 and 8 interact with one combination of the second grounded monopoles designated PM1-8, the second grounded monopoles designated 9-12, the slots designated RS1-12 and the cross-shaped slots 36 designated X1-X4.

By way of example of this interaction, when two active monopoles are positioned horizontally in a side-by-side arrangement, there will be two radiating modes: one radiating mode when the monopoles are driven in-phase and another radiating mode when the monopoles are driven out-of-phase. The out-of-phase mode has current going back and forth between the two active monopoles, thereby resulting in relatively high current levels moving horizontally in the ground plane between the active monopoles. A vertically-oriented slot situated between the active monopoles will impede this current flow as the current must travel around the slot to reach the other active monopole. Therefore, the slot is visible to this mode and, as a result, the mode interacts with the slot. The out-of-phase mode does not interact with a grounded monopole or a horizontally-oriented slot as the mode current is not impeded by these parasitic structures. In contrast, the in-phase mode produces current moving radially in and out from the center of the combined structure and therefore interacts with the grounded monopole (as the current will want to continue all the way up and back down the grounded monopole), but is not impeded by either vertically-oriented or horizontally-oriented slots.

With respect to the 3×3 antenna array of FIG. 35, each mode has different and orthogonal surface current paths amongst the active monopoles, and therefore interacts with the parasitic structures differently. For instance, mode 1 has all active monopoles in-phase so has surface current flowing radially in and out from the structure center, and will interact strongly with the grounded monopoles (most strongly with the central grounded monopole). Mode 9 has all adjacent active monopoles out-of-phase so has surface current flowing back and forth between each pair of adjacent active monopoles and will interact strongly with the slots disposed horizontally in FIG. 35 for the active monopoles that are vertically separated in FIG. 35 and most strongly with the slots disposed vertically in FIG. 35 for the active monopoles that are horizontally separated in FIG. 35. With enough independent degrees of freedom in the parasitic structures, all of the array modes can be mutually balanced resulting in significant port-to-port isolation.

As described above, the self-repeating parasitic structures can balance the orthogonal modes of the 3×3 antenna array. In this regard, FIG. 36 depicts the isolation levels of the 3×3 antenna array among the feeding ports with those isolation levels nearly being less than −25 dB at the resonant frequency, e.g., 1 GHz.

The antenna array of an example embodiment may have any number of active monopoles 14 and parasitic structures. By way of example and with reference to FIG. 37, a 4×4 antenna array 50 having a plurality of active monopoles above a finite ground plane 12 is depicted. In the 4×4 antenna array, the antenna array includes a plurality of first parasitic structures 32, each of which includes a first grounded monopole 34 electrically coupled to the ground plane and a non-conductive cross-shaped slot 36 defined by the ground plane. Each first parasitic structure is centrally disposed with respect to four neighboring active monopoles of the 4×4 antenna array. As shown in FIG. 37, the 4×4 antenna array also includes a plurality of second parasitic structures 38, each of which includes a second grounded monopole 18 and a slot 20, such as a rectangular slot, such as described above.

By mitigating the mutual coupling as a result of the mode balancing of the orthogonal modes provided by the parasitic structures, the antenna of certain example embodiments may provide an improved SINR and allow for convergence of the antenna's signal processing algorithms. Further, the mitigation of mutual coupling provided by the antenna of an example embodiment may provide for improved estimations of carrier frequency offset, channel estimation, angle of arrival, error rate and capacity of the antenna, and may also improve the VSWR. Moreover, as a result of the mode balancing of the orthogonal modes provided by the parasitic structures, the antenna of an example embodiment permits the mutual coupling to be mitigated even in instances in which the antenna is sized to fit within a relative small space, such as afforded by a portable communication device.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. For example, the antenna 10 may include other types of active radiators in addition to or instead of the active monopoles and/or may include other types of grounded radiators in addition to or instead of the grounded monopole. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed is:

1. An apparatus comprising:

a ground plane;

first and second radiators spaced from the ground plane, wherein the first and second radiators are configured to be electrically coupled to at least one of a receiver, a transmitter or a transceiver; and a grounded radiator electrically coupled to the ground plane and positioned between the first and second radiators, wherein the ground plane defines a non-conductive slot positioned between the first and second radiators and bounded by the ground plane.

2. An apparatus according to claim 1 wherein the slot extends in opposite directions from the grounded radiator.

3. An apparatus according to claim 2 wherein the slot extends in equal distances in the opposite directions from the grounded radiator such that the grounded radiator is centrally disposed relative to the slot.

4. An apparatus according to claim 1 wherein the slot comprises a rectangular slot.

5. An apparatus according to claim 4 wherein the first and second radiators are spaced apart from one another along a reference line, and wherein the rectangular slot is oriented relative to the reference line so as to have a width in a direction parallel to the reference line and a length in a direction perpendicular to the reference line.

6. An apparatus according to claim 1 wherein the first and second radiators comprise first and second monopoles, and wherein the grounded radiator comprises a grounded monopole.

7. An apparatus according to claim 6 wherein the grounded monopole extends through the slot.

8. An electronic device comprising the apparatus according to claim 1.

9. An apparatus comprising:

a ground plane;

a plurality of radiators comprising at least first, second, third and fourth radiators, wherein the plurality of radiators are spaced from the ground plane; and a first grounded radiator electrically coupled to the ground plane and centrally disposed relative to the first, second, third and fourth radiators, wherein the ground plane defines a non-conductive cross-shaped slot centrally disposed relative to the first, second, third and fourth radiators, and wherein the cross-shaped slot comprises first and second slot components oriented so as to intersect one another at medial portions thereof.

10. An apparatus according to claim 9 wherein the cross-shaped slot is configured such that the first and second slot components intersect one another at a point of intersection located midway along each of the first and second slot components.

11. An apparatus according to claim 9 wherein the cross-shaped slot is configured such that the first and second slot components are perpendicularly oriented relative to one another.

12. An apparatus according to claim 9 wherein each of the slot components is aligned with and extends along a line between two of the radiators.

13. An apparatus according to claim 9 wherein the first, second, third and fourth radiators comprise first, second, third and fourth monopoles, and wherein the first grounded radiator comprises a first grounded monopole.

14. An apparatus according to claim 13 wherein the cross-shaped slot is configured such that the first and second slot components intersect one another at a point of intersection, and wherein the first grounded monopole extends through the cross-shaped slot at the point of intersection.

15. An apparatus according to claim 9 further comprising a second grounded radiator electrically coupled to the ground plane and positioned between the first and second radiators and a non-conductive slot defined by the ground plane and positioned between the first and second radiators.

16. An apparatus according to claim 15 wherein the slot extends in equal and opposite directions from the second grounded radiator.

17. An apparatus according to claim 15 wherein the first and second radiators are spaced apart from one another along a reference line, wherein the slot is oriented relative to the reference line so as to have a width in a direction parallel to the reference line and a length in a direction perpendicular to the reference line, and wherein the direction perpendicular to the reference line also intersects the first grounded radiator.

18. An apparatus according to claim 15 wherein the second grounded radiator extends through the cross-shaped slot.

19. An apparatus according to claim 15 further comprising a third grounded radiator and a non-conductive slot between the second and third radiators, a fourth grounded radiator and a non-conductive slot between the third and fourth radiators and a fifth grounded radiator and a non-conductive slot between the first and fourth radiators.

20. An apparatus according to claim 9 wherein the plurality of radiators comprise a 3×3 array of radiators, and wherein the apparatus further comprises a plurality of parasitic structures, each parasitic structure comprises a grounded radiator electrically coupled to the ground plane and a non-conductive cross-shaped slot defined by the ground plane, each parasitic structure is centrally disposed with respect to four neighboring radiators of the 3×3 array.

21. An apparatus according to claim 9 wherein the plurality of radiators comprise a 4×4 array of radiators, and wherein the apparatus further comprises a plurality of parasitic structures, each parasitic structure comprises a grounded radiator electrically coupled to the ground plane and a non-conductive cross-shaped slot defined by the ground plane, each parasitic structure is centrally disposed with respect to four neighboring radiators of the 4×4 array.

22. An electronic device comprising the apparatus according to claim 9.

* * * * *